US011707142B2

(12) United States Patent
Nagel

(10) Patent No.: US 11,707,142 B2
(45) **Date of Patent: *Jul. 25, 2023**

(54) RETAIL MERCHANDISE TRAY

(71) Applicant: Fasteners for Retail, Inc., Twinsburg, OH (US)

(72) Inventor: Thomas O. Nagel, Rockford, IL (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/992,268

(22) Filed: Nov. 22, 2022

(65) Prior Publication Data

US 2023/0084806 A1 Mar. 16, 2023

Related U.S. Application Data

(60) Continuation of application No. 17/566,465, filed on Dec. 30, 2021, now Pat. No. 11,510,507, which is a continuation of application No. 17/080,353, filed on Oct. 26, 2020, now Pat. No. 11,350,768, which is a continuation-in-part of application No. 16/876,581, filed on May 18, 2020, now Pat. No. 10,842,294, which is a division of application No. 16/580,768, filed on Sep. 24, 2019, now Pat. No. 10,694,869, which is a continuation of application No.

(Continued)

(51) Int. Cl.

| | |
|---|---|
| ***A47F 1/12*** | (2006.01) |
| ***A47F 5/00*** | (2006.01) |
| ***A47B 57/58*** | (2006.01) |
| *A47B 96/02* | (2006.01) |
| *A47F 1/04* | (2006.01) |

(52) U.S. Cl.

CPC ..... *A47F 1/126* (2013.01); *A47B 57/58* (2013.01); *A47F 5/005* (2013.01); *A47B 96/021* (2013.01); *A47F 1/04* (2013.01); *A47F 1/12* (2013.01)

(58) Field of Classification Search

CPC .. A47F 1/126; A47F 1/125; A47F 1/12; A47F 1/04; A47F 5/005; A47F 5/0025; A47F 2005/165; A47B 57/58; A47B 96/021

See application file for complete search history.

(56) References Cited

U.S. PATENT DOCUMENTS

| | | | |
|---|---|---|---|
| 2,522,896 | A | 9/1950 | Rifkin et al. |
| 4,730,741 | A | 3/1988 | Jackie, III et al. |

(Continued)

FOREIGN PATENT DOCUMENTS

| | | | |
|---|---|---|---|
| CN | 101779876 | A | 7/2010 |
| CN | 104023594 | A | 9/2014 |

(Continued)

OTHER PUBLICATIONS

U.S. Appl. No. 18/090,118, filed Dec. 28, 2022, Nagel.

(Continued)

*Primary Examiner* — Devin K Barnett

(74) *Attorney, Agent, or Firm* — Reinhart Boerner Van Deuren P.C.

(57) ABSTRACT

A retail merchandise tray is provided. The retail merchandise tray includes a frame for supporting retail merchandise, a pusher that slides along the frame, and at least one movable divider assembly adjustable positionable relative to the frame, the divider assembly including a movable baffle plate extension.

19 Claims, 39 Drawing Sheets

Related U.S. Application Data

16/278,589, filed on Feb. 18, 2019, now Pat. No. 10,470,587, which is a continuation of application No. 16/004,066, filed on Jun. 8, 2018, now Pat. No. 10,251,494, which is a continuation-in-part of application No. 15/829,623, filed on Dec. 1, 2017, now Pat. No. 10,034,557.

(56) References Cited

U.S. PATENT DOCUMENTS

| | | | |
|---|---|---|---|
| 5,366,099 | A | 11/1994 | Schmid |
| 5,458,248 | A | 10/1995 | Alain |
| 5,634,564 | A | 6/1997 | Spamer et al. |
| 5,665,304 | A | 9/1997 | Heinen et al. |
| 5,673,801 | A | 10/1997 | Markson |
| 5,855,283 | A | 1/1999 | Johnson |
| 5,865,324 | A | 2/1999 | Jay et al. |
| 5,992,648 | A | 11/1999 | Saunders |
| 6,047,647 | A | 4/2000 | Laraia, Jr. |
| 6,082,558 | A | 7/2000 | Battaglia |
| 6,142,317 | A | 11/2000 | Merl |
| 6,719,152 | B1 | 4/2004 | Nagel et al. |
| 7,424,957 | B1 | 9/2008 | Luberto |
| 7,458,473 | B1 | 12/2008 | Mason |
| 7,690,519 | B2 | 4/2010 | Kahl et al. |
| 7,850,015 | B1 | 12/2010 | Mason |
| 7,850,075 | B1 | 12/2010 | Rosemore et al. |
| 7,918,353 | B1 | 4/2011 | Luberto |
| 8,210,365 | B2 | 7/2012 | Van Wyk |
| 8,657,126 | B1 | 2/2014 | Loftin et al. |
| 8,720,702 | B2 | 5/2014 | Nagel |
| 8,893,902 | B2 | 11/2014 | Dotson et al. |
| 9,138,075 | B2 | 9/2015 | Hardy et al. |
| 9,241,583 | B2 | 1/2016 | Nagel |
| 9,254,049 | B2 | 2/2016 | Nagel |
| 9,629,479 | B2 | 4/2017 | Sosso et al. |
| 9,713,394 | B1 | 7/2017 | Bruegmann |
| 9,801,466 | B2 | 10/2017 | Hardy |
| 9,986,852 | B2 | 6/2018 | Chenoweth et al. |
| 10,034,557 | B1 | 7/2018 | Nagel |
| 10,251,494 | B1 | 4/2019 | Nagel |
| 10,470,587 | B2 | 11/2019 | Nagel |
| 10,492,627 | B2 | 12/2019 | Nagel |
| 10,617,228 | B2 | 4/2020 | Nagel |
| 10,694,869 | B2 | 6/2020 | Nagel |
| 10,709,263 | B2 | 7/2020 | Nagel |
| 10,842,294 | B2 | 11/2020 | Nagel |
| 10,952,547 | B2 | 3/2021 | Nagel |
| 11,350,768 | B2 | 6/2022 | Nagel |
| 11,350,769 | B2 | 6/2022 | Nagel |
| 11,510,507 | B2 | 11/2022 | Nagel |
| 2003/0000956 | A1 | 1/2003 | Maldonado |
| 2003/0057167 | A1 | 3/2003 | Johnson et al. |
| 2003/0217980 | A1 | 11/2003 | Johnson et al. |
| 2004/0000528 | A1 | 1/2004 | Nagel |
| 2004/0079715 | A1 | 4/2004 | Richter et al. |
| 2005/0077260 | A1 | 4/2005 | Mueller et al. |
| 2005/0092702 | A1 | 5/2005 | Nagel |
| 2005/0166806 | A1 | 8/2005 | Hardy |
| 2006/0186064 | A1 | 8/2006 | Merit et al. |
| 2006/0186065 | A1 | 8/2006 | Ciesick |
| 2007/0138114 | A1 | 6/2007 | Dumontet |
| 2007/0170127 | A1 | 7/2007 | Johnson |
| 2007/0175839 | A1 | 8/2007 | Schneider et al. |
| 2009/0223916 | A1 | 9/2009 | Kahl et al. |
| 2010/0025346 | A1 | 2/2010 | Crawbuck et al. |
| 2010/0107670 | A1 | 5/2010 | Kottke et al. |
| 2010/0108624 | A1 | 5/2010 | Sparkowski |
| 2010/0176077 | A1 | 7/2010 | Nagel et al. |
| 2011/0017684 | A1 | 1/2011 | Nagel et al. |
| 2011/0174750 | A1 | 7/2011 | Poulokefalos |
| 2011/0215060 | A1 | 9/2011 | Niederhuefner |
| 2011/0290749 | A1 | 12/2011 | Neumann et al. |
| 2012/0048817 | A1 | 3/2012 | Green et al. |
| 2012/0091079 | A1 | 4/2012 | Schwester et al. |
| 2012/0103922 | A1 | 5/2012 | Bird et al. |
| 2012/0211450 | A1 | 8/2012 | Kologe |
| 2012/0234779 | A1 | 9/2012 | Schneider et al. |
| 2012/0255922 | A1 | 10/2012 | Bryson et al. |
| 2013/0112634 | A1 | 5/2013 | Nagel |
| 2013/0193095 | A1 | 8/2013 | Nagel |
| 2013/0200026 | A1 | 8/2013 | Bryson et al. |
| 2014/0054310 | A1 | 2/2014 | Loftin et al. |
| 2014/0112752 | A1 | 4/2014 | Hardy et al. |
| 2014/0167962 | A1 | 6/2014 | Valiulis et al. |
| 2014/0196807 | A1 | 7/2014 | Ikeda |
| 2014/0305889 | A1 | 10/2014 | Vogler et al. |
| 2014/0319086 | A1 | 10/2014 | Sosso et al. |
| 2015/0021283 | A1 | 1/2015 | Bruegmann |
| 2015/0055434 | A1 | 2/2015 | Mader |
| 2015/0068991 | A1 | 3/2015 | Kostka |
| 2015/0129520 | A1 | 5/2015 | Kologe |
| 2015/0164241 | A1 | 6/2015 | Nagel |
| 2015/0208830 | A1 | 7/2015 | Hardy |
| 2015/0230628 | A1 | 8/2015 | Juric |
| 2015/0257547 | A1 | 9/2015 | Nagel |
| 2015/0289680 | A1 | 10/2015 | Sosso et al. |
| 2016/0022035 | A1 | 1/2016 | Hardy |
| 2016/0286983 | A1 | 10/2016 | Hachmann |
| 2017/0007038 | A1 | 1/2017 | Ewing et al. |
| 2017/0196355 | A1 | 7/2017 | Hardy et al. |
| 2017/0202369 | A1 | 7/2017 | Mercier et al. |
| 2017/0215602 | A1 | 8/2017 | Bruegmann |
| 2017/0224131 | A1 | 8/2017 | Murphy |
| 2017/0295958 | A1 | 10/2017 | Hassell et al. |
| 2018/0020848 | A1 | 1/2018 | Mercier et al. |
| 2018/0070743 | A1 | 3/2018 | Hardy |
| 2018/0153313 | A1 | 6/2018 | Padvoiskis et al. |
| 2022/0202206 | A1 | 6/2022 | Nagel |

FOREIGN PATENT DOCUMENTS

| | | | |
|---|---|---|---|
| CN | 204427390 | U | 7/2015 |
| CN | 105029908 | A | 11/2015 |
| CN | 105795790 | A | 7/2016 |
| CN | 205913129 | U | 2/2017 |
| CN | 106742805 | A | 5/2017 |
| CN | 107072413 | A | 8/2017 |
| EP | 2457472 | A1 | 5/2012 |
| JP | 3205996 | U | 8/2016 |
| TW | M306075 | U | 2/2007 |
| WO | WO 2009/117699 | A2 | 9/2009 |
| WO | WO 2017/015466 | A1 | 1/2017 |
| WO | WO 2017/127456 | A1 | 7/2017 |

OTHER PUBLICATIONS

U.S. Appl. No. 15/829,623, filed Dec. 1, 2017.
U.S. Appl. No. 16/004,066, filed Jun. 8, 2018.
U.S. Appl. No. 16/278,589, filed Feb. 18, 2019.
U.S. Appl. No. 16/580,768, filed Sep. 24, 2019.
U.S. Appl. No. 16/876,581, filed May 18, 2020.
U.S. Appl. No. 17/080,353, filed Oct. 26, 2020.
U.S. Appl. No. 17/566,465, filed Dec. 30, 2021.

RETAIL MERCHANDISE TRAY

CROSS-REFERENCE TO RELATED PATENT APPLICATION

This application is a continuation of U.S. patent application Ser. No. 17/566,465, filed Dec. 30, 2021, which is a continuation of U.S. patent application Ser. No. 17/080,353, filed Oct. 26, 2020, which is now U.S. Pat. No. 11,350,768, issued Jun. 7, 2022, which is a continuation-in-part of U.S. patent application Ser. No. 16/876,581, filed May 18, 2020, which is now U.S. Pat. No. 10,842,294, issued Nov. 24, 2020, which is a divisional application of U.S. patent application Ser. No. 16/580,768, filed Sep. 24, 2019, which is now U.S. Pat. No. 10,694,869, issued Jun. 30, 2020, which is a continuation of U.S. patent application Ser. No. 16/278,589, filed Feb. 18, 2019, which is now U.S. Pat. No. 10,470,587, issued Nov. 12, 2019, which is a continuation of U.S. patent application Ser. No. 16/004,066, filed Jun. 8, 2018, which is now U.S. Pat. No. 10,251,494, issued Apr. 9, 2019, which is a continuation-in-part of U.S. patent application Ser. No. 15/829,623, filed Dec. 1, 2017, which is now U.S. Pat. No. 10,034,557, issued Jul. 31, 2018, the entire teachings and disclosures each of which are incorporated herein by reference thereto.

FIELD OF THE INVENTION

This invention generally relates to retail merchandise displays, and more particularly to self-facing retail merchandise displays used for biasing retail merchandise forward.

BACKGROUND OF THE INVENTION

Self-facing retail merchandise displays are generally known in the art. One such display is the pusher system. A conventional pusher system incorporates one or more pusher paddles or pusher bodies that ride along a respective elongated track. A spring is connected between the pusher body and a leading edge of the track. The spring acts to bias the pusher body forward along the track towards the leading edge thereof.

A user can retract the pusher body away from the leading edge of the track and position items of retail merchandise in a linear row on top of the track and between the leading edge of the track and the pusher body. The biasing force provided by the spring and exerted upon the pusher body serves to bias the linear row of retail merchandise forward to ultimately "front face" the merchandise.

That is, when a customer removes the leading most item of merchandise from the linear row of merchandise, the pusher body will be drawn forward by the spring to index the row of merchandise forward so that the next item of merchandise in the row is positioned proximate the leading edge of the track in an aesthetically pleasing manner. Such automatic front facing eliminates the necessity for retail store employees to manually face the merchandise, and thus ultimately reduces the cost of labor of the retailer.

The aforementioned pusher systems have been utilized in various retail display environments. One example is a retail shelf. Typically, a plurality of pusher bodies and their corresponding tracks are arranged in a side by side manner along the shelf. Each pusher body and its corresponding track are separated by dividers to maintain a plurality of generally straight rows of merchandise that run from the front to the back of the shelf. Such a familiar configuration can be found in many retail stores for selling hygiene items such as deodorant, as one example.

In another configuration, the pusher system may be embodied as a stand-alone pusher tray. These trays may include means for mounting the tray as a cantilevered extension from another structure, such as a bar. These trays may also be situated directly on a retail shelf. Further, these trays may include side barriers which are adjustable so as to accommodate merchandise of differing widths. Examples of these trays may be readily seen at U.S. Pat. Nos. 9,254,049, 9,241,583, 8,720,702, each of which is incorporated by reference herein in its entirety.

The invention relates to improvements in the above described pusher systems, more particularly, the above described pusher trays. These and other advantages of the invention, as well as additional inventive features, will be apparent from the description of the invention provided herein.

BRIEF SUMMARY OF THE INVENTION

In one aspect, the invention provides a retail merchandise tray which incorporates an easily installed wire support structure. A retail merchandise tray according to this aspect has the advantage of not requiring any welding process for affixing the wire support structure to the remainder of the tray. An embodiment according to this aspect includes a pair of opposed load bearing members and a front stop mounted to the pair of load bearing members. This embodiment of a retail merchandise tray also includes a wire support structure having opposed first and second ends. The wire support structure is removably attached at the first end to the front stop and removably attached at the second end to the pair of load bearing members. This embodiment of a retail merchandise tray also includes a pusher mounted to the wire support structure and movable along the wire support structure toward and away from the front stop along a first axis. At least one divider assembly is also includes and is movable relative to the pair of opposed load bearing members along a second axis perpendicular to the first axis. A pair of spacers are aligned along the first axis and interposed between the pair of load bearing members and situated below the wire support frame.

In embodiments according to this aspect, the at least one divider assembly includes a pair of divider assemblies movable about the second axis and arranged such that the pair of load bearing members are interposed between the pair of divider assemblies. The at least one divider assembly includes a divider wall and a pair of wire supports. The pair of wire supports are removably attached to the divider by a resilient connection.

In embodiments according to this aspect, the divider wall includes an upright portion having opposed sides. A flange extends from at least one of the opposed sides perpendicular to the upright portion. The at least one divider assembly includes a baffle plate extension connected to the at least one flange by a slidable connection. The baffle plate extension is mounted to each of the pair of spacers by a slidable connection such that the baffle plate extension is slidable relative to the pair of spacers and relative to the divider wall. The slidable connection between the baffle plate extension and the at least one flange comprises a tab depending downwardly from the flange and a slot formed in the baffle plate extension which receives the tab. The slidable connection between the baffle plate extension and the pair of spacers includes a pair of clips formed on the baffle plate extension, with one clip of the pair of clips connected to one spacer of the pair of spacers, and the other clip of the pair of clips connected to the other spacer of the pair of spacers.

In embodiments according to this aspect, a baffle plate is connected to the pair of spacers. The baffle plate includes a pair of clips, with one clip of the pair of clips connected to one spacer of the pair of spacers, and the other clip of the pair of clips connected to the other spacer of the pair of spacers.

In embodiments according to this aspect, a shelf mounting arrangement for mounting the retail merchandise tray to a shelf is provided. The shelf mounting arrangement includes one of a mounting plate that is removably attached to one of the pair of spacers. The mounting plate has extensions configured to extend into apertures of the shelf to fix the tray to the shelf, or a mounting rail configured for mounting to the retail shelf and at least one mounting tab, the mounting rail including a plurality of spaced apart teeth arranged to receive the at least one mounting tab in a space between adjacent teeth, the at least one mounting tab being formed on the front stop.

In embodiments according to this aspect, the front stop includes a mounting portion and an upright portion. The mounting portion is one of integrally formed with the upright portion as a rigid one piece component or formed as a separate piece from the upright portion, with a hinge formed between the upright portion and the mounting portion such that the upright portion is rotatable about the hinge relative to the mounting portion.

In embodiments according to this aspect, the wire support structure includes a lateral element and at least one longitudinal element extending from the lateral element. The lateral element includes a pair of opposed ends, with a key formed adjacent each one of the opposed ends. Each key is arranged to pass through a keyway formed in each one of the pair of load bearing members, respectively, such that the pair of load bearing members are interposed between the keys formed at each end of the lateral member.

In another aspect, the invention provides a retail merchandise tray which employs divider assemblies that are assembled by a resilient connection. This has the advantage of avoiding any welding relative to the divider assemblies, and allows for rapidly replacing divider walls of the divider assemblies. An embodiment according to this aspect includes a pair of opposed load bearing members with a front stop mounted to the pair of load bearing members. This embodiment of a retail merchandise tray also includes a wire support structure including a lateral element and at least one longitudinal element extending from the lateral element. The at least one longitudinal element extends parallel to the pair of load bearing members and is interposed between the pair of load bearing members. A pusher is mounted to the wire support structure. The pusher is movable along the wire support structure toward and away from the front stop along a first axis. This embodiment of a retail merchandise tray also includes at least one divider assembly movable relative to the pair of opposed load bearing members along a second axis perpendicular to the first axis. The at least one divider includes a divider wall and a pair of wire supports, the pair of wire supports are removably attached to the divider by a resilient connection. A pair of spacers are aligned along the first axis and interposed between the pair of load bearing members and situated below the wire support frame. The pair of spacers receiving the wire supports of the at least one divider.

In embodiments according to this aspect, the at least one divider assembly includes a pair of divider assemblies movable about the second axis and arranged such that the pair of load bearing members are interposed between the pair of divider assemblies.

In embodiments according to this aspect, the wire support structure has opposed first and second ends. The wire support structure is removably attached at the first end to the front stop and removably attached at the second end to the pair of load bearing members.

In embodiments according to this aspect, the divider wall includes an upright portion having opposed sides. A flange extends from at least one of the opposed sides perpendicular to the upright portion. The at least one divider assembly includes a baffle plate extension connected to the at least one flange by a slidable connection. The baffle plate extension is mounted to each of the pair of spacers by a slidable connection such that the baffle plate extension is slidable relative to the pair of spacers and relative to the divider wall. The slidable connection between the baffle plate extension and the at least one flange comprises a tab depending downwardly from the flange and a slot formed in the baffle plate extension which receives the tab. The slidable connection between the baffle plate extension and the pair of spacers includes a pair of clips formed on the baffle plate extension, with one clip of the pair of clips connected to one spacer of the pair of spacers, and the other clip of the pair of clips connected to the other spacer of the pair of spacers.

In embodiments according to this aspect, a baffle plate is connected to the pair of spacers. The baffle plate includes a pair of clips, with one clip of the pair of clips connected to one spacer of the pair of spacers, and the other clip of the pair of clips connected to the other spacer of the pair of spacers.

In embodiments according to this aspect, a shelf mounting arrangement for mounting the retail merchandise tray to a shelf is provided. The shelf mounting arrangement includes one of a mounting plate that is removably attached to one of the pair of spacers. The mounting plate has extensions configured to extend into apertures of the shelf to fix the tray to the shelf, or a mounting rail configured for mounting to the retail shelf and at least one mounting tab, the mounting rail including a plurality of spaced apart teeth arranged to receive the at least one mounting tab in a space between adjacent teeth, the at least one mounting tab being formed on the front stop.

In embodiments according to this aspect, the front stop includes a mounting portion and an upright portion. The mounting portion is one of integrally formed with the upright portion as a rigid one piece component or formed as a separate piece from the upright portion, with a hinge formed between the upright portion and the mounting portion such that the upright portion is rotatable about the hinge relative to the mounting portion.

In embodiments according to this aspect, the wire support structure includes a lateral element and at least one longitudinal element extending from the lateral element. The lateral element includes a pair of opposed ends, with a key formed adjacent each one of the opposed ends. Each key is arranged to pass through a keyway formed in each one of the pair of load bearing members, respectively, such that the pair of load bearing members are interposed between the keys formed at each end of the lateral member.

In yet another aspect, the invention provides a retail merchandise tray which advantageously utilizes a keying arrangement for mounting a wire support structure. An embodiment according to this aspect includes a pair of opposed load bearing members with a front stop mounted to the pair of load bearing members. This embodiment of a retail merchandise tray also includes a wire support structure that includes a lateral element and at least one longitudinal element extending from the lateral element. The lateral element includes a pair of opposed ends. A key is formed adjacent each one of the opposed ends. Each key is arranged to pass through a keyway formed in each one of the pair of load bearing members, respectively, such that the pair of load bearing members are interposed between the keys formed at each end of the lateral member. This embodiment of a retail merchandise tray also includes a pusher mounted to the wire support structure. The pusher is movable along the wire support structure toward and away from the front stop along a first axis. At least one divider assembly is movable relative to the pair of opposed load bearing members along a second axis perpendicular to the first axis. A pair of spacers are aligned along the first axis and interposed between the pair of load bearing members and situated below the wire support frame.

In embodiments according to this aspect, the at least one divider assembly includes a pair of divider assemblies movable about the second axis and arranged such that the pair of load bearing members are interposed between the pair of divider assemblies.

In embodiments according to this aspect, the wire support structure has opposed first and second ends. The wire support structure is removably attached at the first end to the front stop and removably attached at the second end to the pair of load bearing members.

In embodiments according to this aspect, the divider wall includes an upright portion having opposed sides. A flange extends from at least one of the opposed sides perpendicular to the upright portion. The at least one divider assembly includes a baffle plate extension connected to the at least one flange by a slidable connection. The baffle plate extension is mounted to each of the pair of spacers by a slidable connection such that the baffle plate extension is slidable relative to the pair of spacers and relative to the divider wall. The slidable connection between the baffle plate extension and the at least one flange comprises a tab depending downwardly from the flange and a slot formed in the baffle plate extension which receives the tab. The slidable connection between the baffle plate extension and the pair of spacers includes a pair of clips formed on the baffle plate extension, with one clip of the pair of clips connected to one spacer of the pair of spacers, and the other clip of the pair of clips connected to the other spacer of the pair of spacers.

In embodiments according to this aspect, a baffle plate is connected to the pair of spacers. The baffle plate includes a pair of clips, with one clip of the pair of clips connected to one spacer of the pair of spacers, and the other clip of the pair of clips connected to the other spacer of the pair of spacers.

In embodiments according to this aspect, a shelf mounting arrangement for mounting the retail merchandise tray to a shelf is provided. The shelf mounting arrangement includes one of a mounting plate that is removably attached to one of the pair of spacers. The mounting plate has extensions configured to extend into apertures of the shelf to fix the tray to the shelf, or a mounting rail configured for mounting to the retail shelf and at least one mounting tab, the mounting rail including a plurality of spaced apart teeth arranged to receive the at least one mounting tab in a space between adjacent teeth, the at least one mounting tab being formed on the front stop.

In embodiments according to this aspect, the front stop includes a mounting portion and an upright portion. The mounting portion is one of integrally formed with the upright portion as a rigid one piece component or formed as a separate piece from the upright portion, with a hinge formed between the upright portion and the mounting portion such that the upright portion is rotatable about the hinge relative to the mounting portion.

In embodiments according to this aspect, the at least one divider assembly includes a divider wall and a pair of wire supports. The pair of wire supports are removably attached to the divider by a resilient connection.

In yet another aspect, the invention provides a retail merchandise tray. A retail merchandise tray according to this aspect includes a pair of opposed load bearing members, a front stop mounted to the pair of load bearing members, a wire support structure supported at least in part by the pair of load bearing members, and a pusher mounted to the wire support structure. The pusher is movable along the wire support structure toward and away from the front stop along a first axis. The retail merchandise tray also includes at least one divider assembly is movable relative to the pair of opposed load bearing members along a second axis perpendicular to the first axis and a pair of spacers aligned along the first axis and interposed between the pair of load bearing members and situated below the wire support frame. The retail merchandise tray also includes a baffle plate movable relative to the pair of load bearing members and relative to the wire support frame.

In certain embodiments according to this aspect, the a tab plate extends between the pair of opposed load bearing member and includes a downwardly depending tab. The baffle plate includes a slot. The tab extends through the slot. An abutted contact between the tab and an end of the slot define a limit position of sliding movement of the baffle plate relative to the pair of opposed load bearing members.

In certain embodiments according to this aspect, the baffle plate includes a pair of opposed sidewalls extending parallel to the pair of opposed load bearing members. A cut out in the form of a downwardly opening hook is provided in each of the pair of opposed sidewalls, the cut out configured to receive a retail merchandise support bar. The pair of opposed sidewalls are in sliding contact with the pair of opposed load bearing members.

In certain embodiments according to this aspect, the pusher includes a locking arm. The locking arm is operable to lock the pusher in a locked position. In the locked position, the pusher is prevented from moving toward the front stop along the first axis. The baffle plate includes an unlocking tab. Sliding the baffle plate along the first axis toward the front stop causes the unlocking tab to engage the locking arm and transition the locking arm from the locked position to an unlocked position wherein the pusher is free to move toward the front stop along the first axis.

In certain embodiments according to this aspect, the baffle plate is slidably mounted between the pair of load bearing members and is slidable relative to the pair of load bearing members and the wire support structure along the first axis such that the retail merchandise tray has a first longitudinal length in a first position of the baffle plate relative to the pair of load bearing members and the wire support structure, and a second longitudinal length greater than the first longitudinal length in a second position of the baffle plate relative to the pair of load bearing members and the wire support structure.

In yet another aspect, the invention provides a retail merchandise tray. An embodiment of retail merchandise tray according to this aspect includes a pair of opposed load bearing members, a front stop mounted to the pair of load bearing members, a wire support structure supported at least in part by the pair of load bearing members, and a pusher mounted to the wire support structure and movable along the wire support structure toward and away from the front stop along a first axis. The retail merchandise tray also includes at least one divider assembly movable relative to the pair of opposed load bearing members along a second axis perpendicular to the first axis. A pair of spacers are aligned along the first axis and interposed between the pair of load bearing members. The retail merchandise tray also includes a baffle plate slidably mounted between the pair of load bearing members. The baffle plate is slidable relative to the pair of load bearing members and the wire support structure along the first axis such that the retail merchandise tray has a first longitudinal length in a first position of the baffle plate relative to the pair of load bearing members and the wire support structure, and a second longitudinal length greater than the first longitudinal length in a second position of the baffle plate relative to the pair of load bearing members and the wire support structure.

In certain embodiments according to this aspect, the baffle plate includes a pair of opposed sidewalls extending parallel to the pair of opposed load bearing members. A cut out in the form of a downwardly opening hook is provided in each of the pair of opposed sidewalls, the cut out configured to receive a retail merchandise support bar. The pair of opposed sidewalls are in sliding contact with the pair of opposed load bearing members.

In certain embodiments according to this aspect, the pusher includes a locking arm. The locking arm is operable to lock the pusher in a locked position. In the locked position, the pusher is prevented from moving toward the front stop along the first axis. The baffle plate includes an unlocking tab. Sliding the baffle plate along the first axis toward the front stop causes the unlocking tab to engage the locking arm and transition the locking arm from the locked position to an unlocked position wherein the pusher is free to move toward the front stop along the first axis.

In yet another aspect, the invention provides a method for loading a retail merchandise tray. An embodiment of a retail merchandise tray according to this aspect includes a pair of opposed load bearing members, a front stop mounted to the pair of load bearing members, a wire support structure supported at least in part by the pair of load bearing members, a pusher mounted to the wire support structure, the pusher movable along the wire support structure toward and away from the front stop along a first axis, at least one divider assembly movable relative to the pair of opposed load bearing members along a second axis perpendicular to the first axis, a pair of spacers aligned along the first axis and interposed between the pair of load bearing members, and a baffle plate slidably mounted between the pair of load bearing members. An embodiment of a method according to this aspect includes sliding the baffle plate along the first axis relative to the pair of opposed load bearing members away from the front stop, moving the pusher to a position adjacent a rear of the wire support frame, locking the pusher to the wire support frame to place the pusher in a locked position, loading retail merchandise onto the wire support frame, and sliding the baffle plate along the first axis relative to the pair of opposed load bearing members toward the front stop.

In certain embodiments according to this aspect, the step of sliding the baffle plate along the first axis toward the front stop includes automatically transitioning the pusher from the locked position to an unlocked position via contact between the baffle plate and a locking arm of the pusher.

In one embodiment, a retail merchandise tray including a frame, a pusher, and at least one divider assembly is provided. The frame provides a retail merchandise support surface. The pusher mounts to the frame. The pusher is movable along the frame along a first axis between a font end and a rear end of the frame. The least one divider assembly is movable relative to the frame along a second axis perpendicular to the first axis. The at least one divider assembly includes a divider wall, at least one wire support and a baffle plate extension. The at least one wire support slidably attaches the divider wall to the frame for movement along the second axis between a retracted orientation and an extended orientation. The baffle plate extension connects to the at least one wire support by a slidable connection providing a first amount of sliding friction. The baffle plate extension is slidably supported by the frame providing a second amount of sliding friction less than the first amount of sliding friction such that the baffle plate extension is slidable relative to the frame and the at least one wire support.

In one embodiment, the slidable connection between the at least one wire support and the baffle plate extension is provided by an outer clip portion of the baffle plate extension that engages the at least one wire support.

In one embodiment, the baffle plate extension has a downward extending stop that limits the outward travel of the baffle plate extension relative to the frame.

In one embodiment, when the divider wall transitions to the extended orientation from the retracted orientation, the stop engages the frame limiting outward motion of the baffle plate extension before the divider wall reaches the extended orientation.

In one embodiment, the first amount of sliding friction and second amount of sliding friction are such that the baffle plate extension does not slide relative to the at least one wire support when the divider wall transitions from the retracted orientation to the extended orientation until the stop engages the frame.

In one embodiment, the divider wall includes an upright portion having opposed sides and a flange extending from at least one of the opposed sides perpendicular to the upright portion. In the retracted orientation, the flange overlaps both a portion of the frame and the baffle plate extension with the baffle plate extension being positioned between the flange and the portion of the frame.

In one embodiment, the baffle plate extension includes a main panel portion and an outer clip portion. The outer clip portion extends downward from a bottom side of the main panel portion that faces the at least one wire support. The outer clip portion is positioned laterally outward beyond a first side of the frame along the second axis. The outer clip portion slidably engages the at least one wire support and provides the first amount of sliding friction.

In one embodiment, the main panel portion and outer clip portion are unitarily formed as a one-piece construction.

In one embodiment, the stop is positioned laterally inward of the first side of the frame along the second axis. The baffle plate extension includes an inner sliding support member that slidably rests on a portion of the frame providing the second amount of sliding friction. The inner sliding support member being positioned laterally inward of the first side of the frame along the second axis such that the first side of the frame is positioned laterally between the outer clip portion and the inner sliding support member.

In one embodiment, the inner sliding support member is an inner clip portion that engages the portion of the frame along which the inner sliding support member slides.

In one embodiment, the main panel portion of the baffle plate extension is free of slots or grooves therein.

In one embodiment, the divider wall includes an upright portion having opposed sides and a flange extending from at least one of the opposed sides perpendicular to the upright portion. The flange is free of slots or grooves therein. Having the baffle plate extension and/or flange free of slots or grooves reduces the risk of debris begin trapped therein.

In one embodiment, the divider wall includes an upright portion having opposed sides and a flange extends from at least one of the opposed sides perpendicular to the upright portion. In the retracted orientation, the flange overlaps both a portion of the frame and the baffle plate extension with the baffle plate extension being positioned between the flange and the portion of the frame.

In one embodiment, the outer clip portion laterally abuts the frame when the divider wall is in the retracted orientation.

In one embodiment, the frame includes: a pair of opposed load bearing members; a wire support structure having opposed first and second ends, the first axis extending between the first and second ends, the wire support structure being supported by the pair of opposed load bearing members; at least one spacer interposed between the pair of load bearing members and extending along the second axis; and the baffle plate extension includes an inner sliding support member that slidably rests on the at least one spacer providing the second amount of sliding friction, the inner sliding support member being positioned laterally between the pair of opposed load bearing members.

In one embodiment, the baffle plate extension includes a main panel portion and an outer clip portion; the outer clip portion extending downward from a bottom side of the main panel portion that faces the at least one wire support; the outer clip portion is positioned laterally outward beyond the load bearing members such that both load bearing members are on a same side of the outer clip portion; the outer clip portion slidably engages the at least one wire support and provides the first amount of sliding friction.

In one embodiment, the outer clip portion laterally abuts a first side of one of the load bearing members in the retracted orientation and the inner sliding support member is spaced from the one of the load bearing members in the retracted orientation; the outer clip portion is laterally spaced from the first side of the one of the load bearing members in the extended orientation and the inner sliding support member abuts a second side of the one of the load bearing members in the extended orientation.

In one embodiment, a method of transitioning a retail merchandise tray as outlined above between the retracted orientation and the extended orientation is provided. The method includes applying force to the divider wall to slide the divider wall along the second axis relative to the frame for a first distance; moving the baffle plate extension along the second axis with the divider wall for the first distance due to the first amount of sliding friction provided between the slidable connection between the baffle plate extension and the at least one wire support while overcoming the second amount of sliding friction between the baffle plate extension and the frame; stopping motion of the baffle plate extension along the second axis; and continuing to move the divider wall relative to the frame while the baffle plate extension is stopped by overcoming the first amount of sliding friction between the baffle plate extension and the at least one wire support.

In one embodiment, the step of stopping motion of the baffle plate extension occurs by abutting a stop of the baffle plate extension against a portion of the frame.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now the drawings, various embodiments of a retail merchandise tray are illustrated. A retail merchandise tray (hereinafter referred to as a "tray") according to the teachings herein as the advantage of having a reduced assembly time and cost due in part to the weld-free interconnection of its various components. Further, a tray according to the teachings herein presents a new and improved baffle plate methodology, which heretofore required a separate plate to be positioned under the tray with its own independent mounting. Still further, a tray according to the teachings herein presents a new and improved shelf mounting configuration for those trays which mount directly to a retail shelf. These and other advantages will be understood from the following detailed description.

Figure 1:
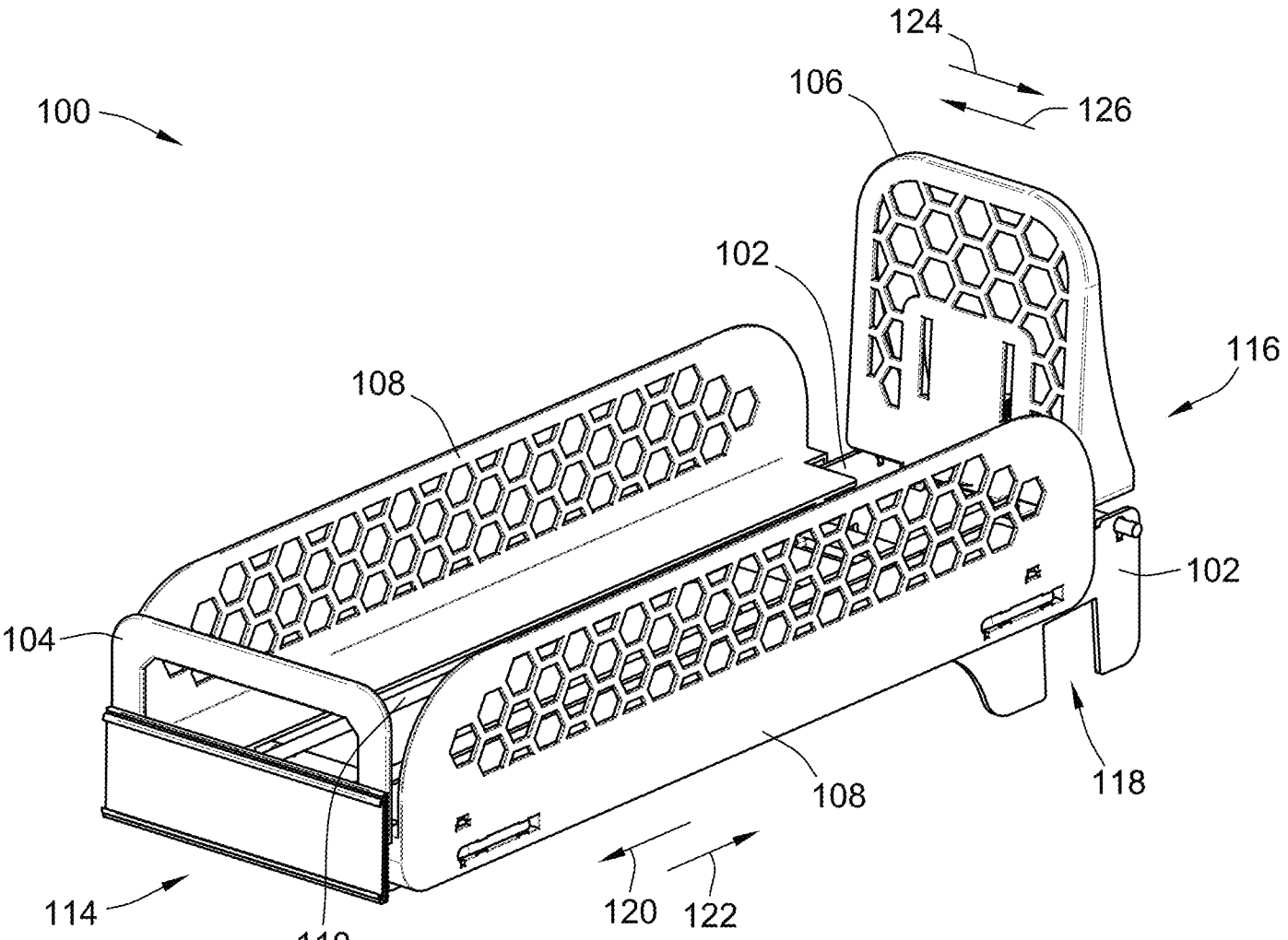
FIG. 1 is a perspective view of an exemplary embodiment of a retail merchandise tray according to the teachings herein.

Turning first to FIG. 1, the same illustrates a tray 100 having a pair of load bearing members 102. Load bearing members 102 are identical so a description of one applies equally well to the other. A front stop 104 is connected to the load bearing members at a first end 114 of tray 100. Front stop 104 may include additional integrated or attached structures such as price channel extrusions, faceplates, etc.

A wire support frame 110 (see FIG. 2) is removably to the load bearing members adjacent a second end 116 of tray 100. This wire support frame is also removably attached to front stop 104 adjacent first end 114. Put differently, wire support frame has opposed first and second ends which are adjacent first and second ends 114, 116 of tray 100, respectively.

The first end of wire support frame 110 is removably attached to front stop 104, while the second end is removably attached to load bearing members 102. As used herein, "removably attached" means an attachment which may be readily undone in a non-destructive manner and subsequently repeated in the same manner. Within this meaning "removably attached" does not include welds, comolding, or other permanent forms of attachment which require component destruction or damage to undo.

A pusher 106 is mounted to wire support structure 110 and slidable thereon in directions 120, 122. Pusher 106 is operable to bias a row or rows of retail merchandise situated on top of wire support structure 110 and load bearing members 102 from second end 116 of tray 100 to first end 114 of tray 100. As may be seen from inspection of FIG. 1, pusher 106 may employ a honeycomb structure to reduce its overall weight. As will be explained below, pusher 106 is biased under the force of a coil spring or other biasing element.

A pair of movable divider assemblies 108 are positioned on either side of tray 100. Divider assemblies 108 are movable in directions 124, 126 to modify a width or distance between the divider assemblies 108. This lateral adjustment allows for the accommodating retail merchandise of differing widths. As will be explained below, divider assemblies 108 employ a removable attachment between their divider walls and wire supports. This advantageously allows for the connection of the divider walls using a resilient or "snap" connection. As a result, lightweight materials may be utilized for the divider walls themselves, while more robust materials may be utilized for the wire supports.

As may also be seen in FIG. 1, each load bearing member 102 includes a cut-out 118 sized to receive a retail merchandise bar of the type typically found in refrigerated cases or other retail merchandise displays. This allows for a cantilevered mounting of tray 100.

Figure 2:
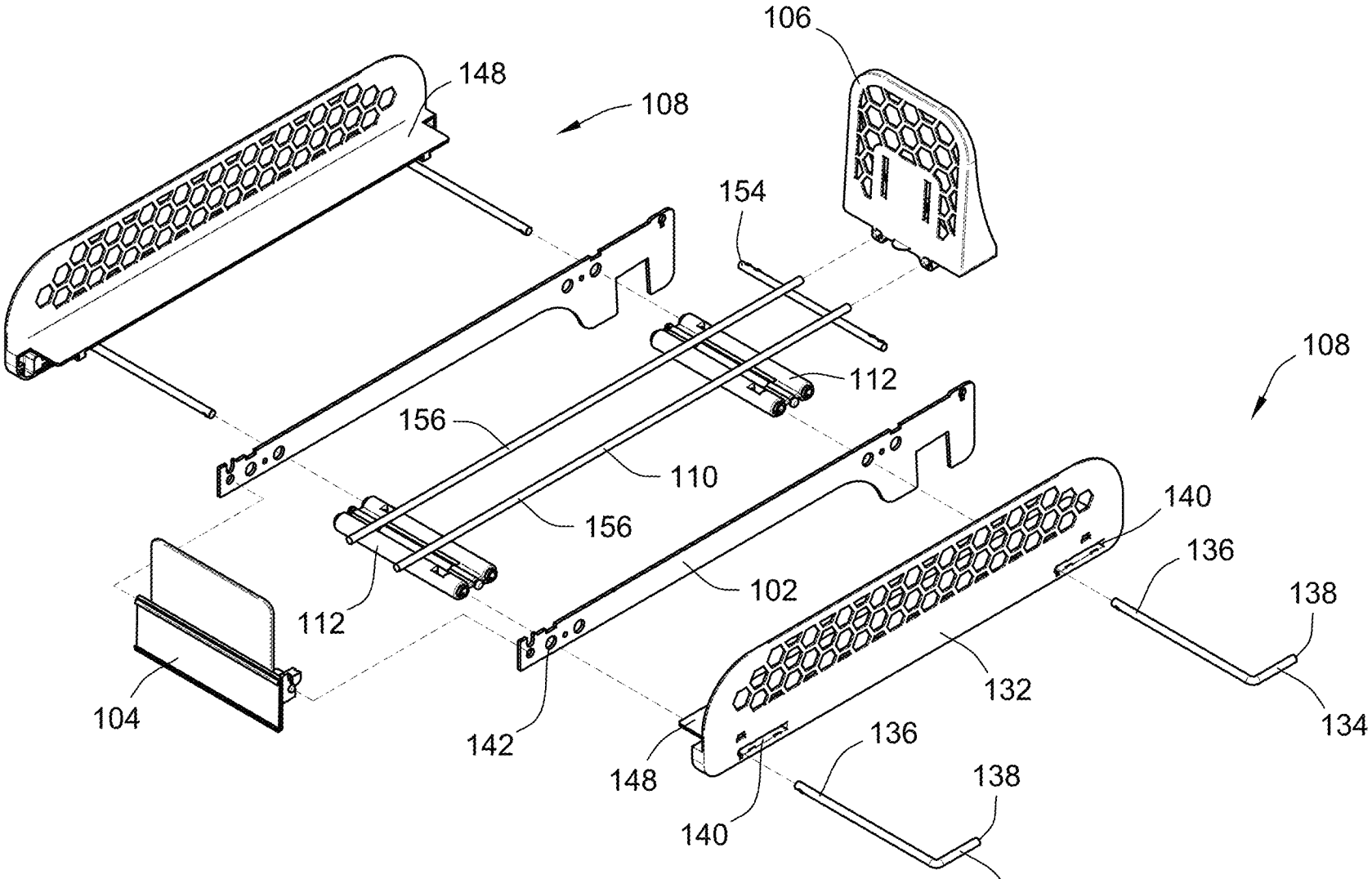
FIG. 2 is an exploded perspective view of the retail merchandise tray of FIG. 1.

Turning now to FIG. 2, divider 100 is illustrated in an exploded view. As may be seen in this view, tray 100 also includes spacers 112 which are used on the one hand to maintain the lateral spacing between load bearing members 102, and on the other hand to receive wire supports of divider assemblies 108 as discussed below. Spacers 112 are identical so a description of one applies equally well to the other. These spacers may formed of a lightweight material such as plastic or the like, and attach at their side edges to load bearing members 102 such that spacers 112 are interposed between load bearing members 102.

The two divider assemblies 108 shown are identical. As such, a description of one applies equally well to the other. It should also be noted that although two dividers assemblies 108 are shown, only a single divider assembly 108 may be employed in some alternate configurations, while in other alternate configurations, the divider assemblies 108 may be entirely omitted.

Divider assembly 108 includes a divider wall 132 and a pair of wire supports 134 which are removably attached to divider wall 132. Each wire support 134 connects to divider wall 132 with a resilient "snap" style connection to thereby hold it in place during operation. Divider wall also includes a flange 148 depending perpendicular to its remaining generally upright presentation. This flange 148 may be utilized to support merchandise extending laterally beyond load bearing members 102.

Each wire support 134 includes a straight portion 136 and a bent portion 138 generally at a right angle to straight portion 136. Bent portions 138 are received in corresponding slots 140 formed in divider wall 132. Each slot has a passage formed therein for receipt of straight portion 136 such that straight portion 136 passes through divider wall 132 until bent portion 138 bottoms out in slot 140. This configuration allows for divider assembly 108 to be of a multi-material construction, with wire supports 134 formed of a rigid material such as metal, while divider wall 132 may be formed of a lightweight material such as plastic for example. Further, as was the case with pusher 106, divider wall 132 may also employ a honeycomb structure to reduce its overall weight.

Still referring to FIG. 2, wire support structure 110 includes a lateral member 154 and a pair of longitudinal members 156 extending generally perpendicular to lateral member 154. As its name implies, wire support structure 110 is formed of metal wire, with longitudinal members 156 welded to lateral member 154. Although two longitudinal elements 156 are illustrated, fewer or greater longitudinal members 156 may be employed depending on the overall width of tray 100.

Figure 3:
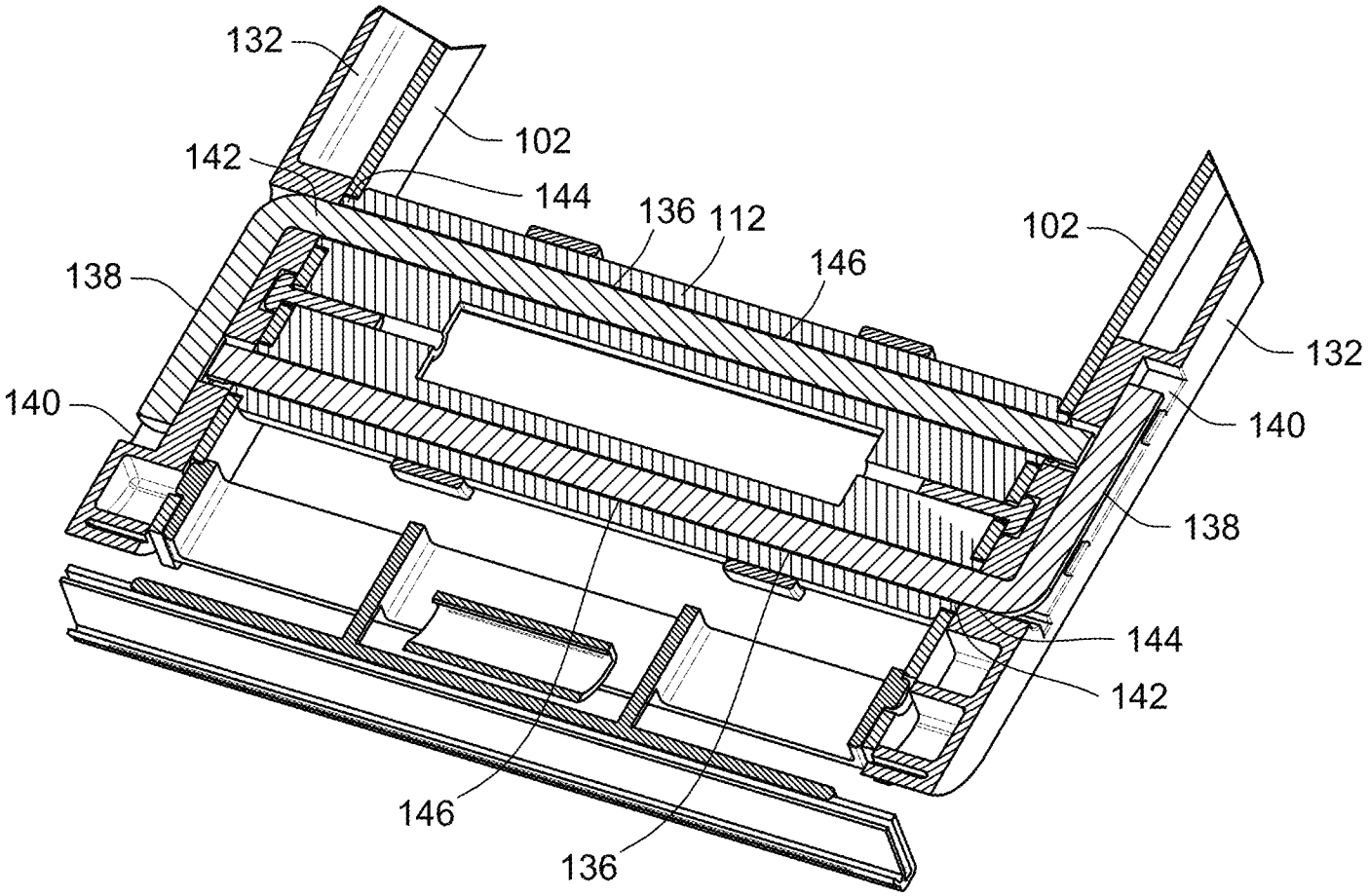
FIG. 3 is a cross section of the retail merchandise tray of FIG. 1, taken in the region of a spacer.

With reference now to FIG. 3, the same illustrates a cross section through the front most spacer 112 shown in FIG. 2. This view illustrates the reception of bent portion 138 in slot 140. Additionally, this view also illustrates the passageway 144 formed in divider wall 132 within slot 140. A corresponding passageway 142 is also formed in each load bearing member 102 and is aligned with passageway 144 of divider wall 132. This alignment allows for straight portions 136 to pass through divider wall 132, through load bearing member 102, and into a corresponding passageway 146 of spacer 112. Each spacer 112 has a pair of passageways 146 which overlap one another as shown. Spacers 112 attach to load bearing members 102 via fasteners such as those shown, or any other mechanical expedient.

Figure 4:
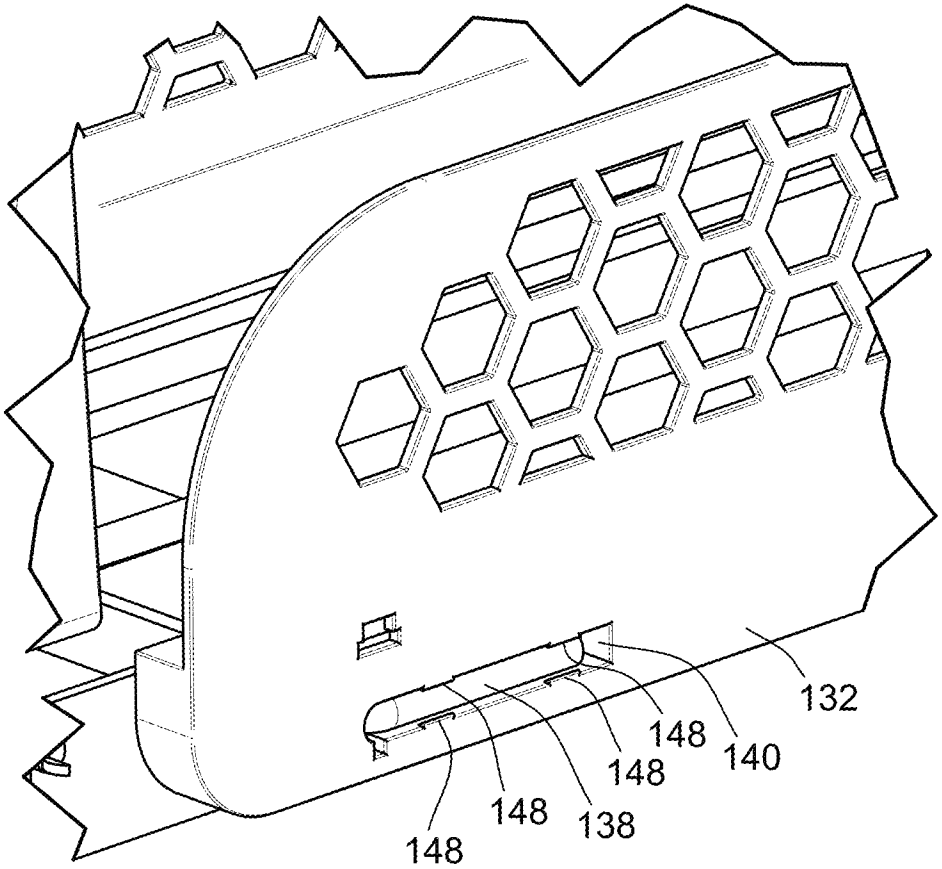
FIG. 4 is a partial perspective view a divider assembly of FIG. 1, illustrating a resilient connection thereof.

With reference to FIG. 4, each slot 140 includes a number of resilient tabs 148. These tabs extend within slot 140 such that as bent portion 138 enters slot 140, these tabs will elastically deform out of the way, and then return to their original position as shown in FIG. 4. This holds each wire support 134 in place relative to divider wall 132.

Figure 5:
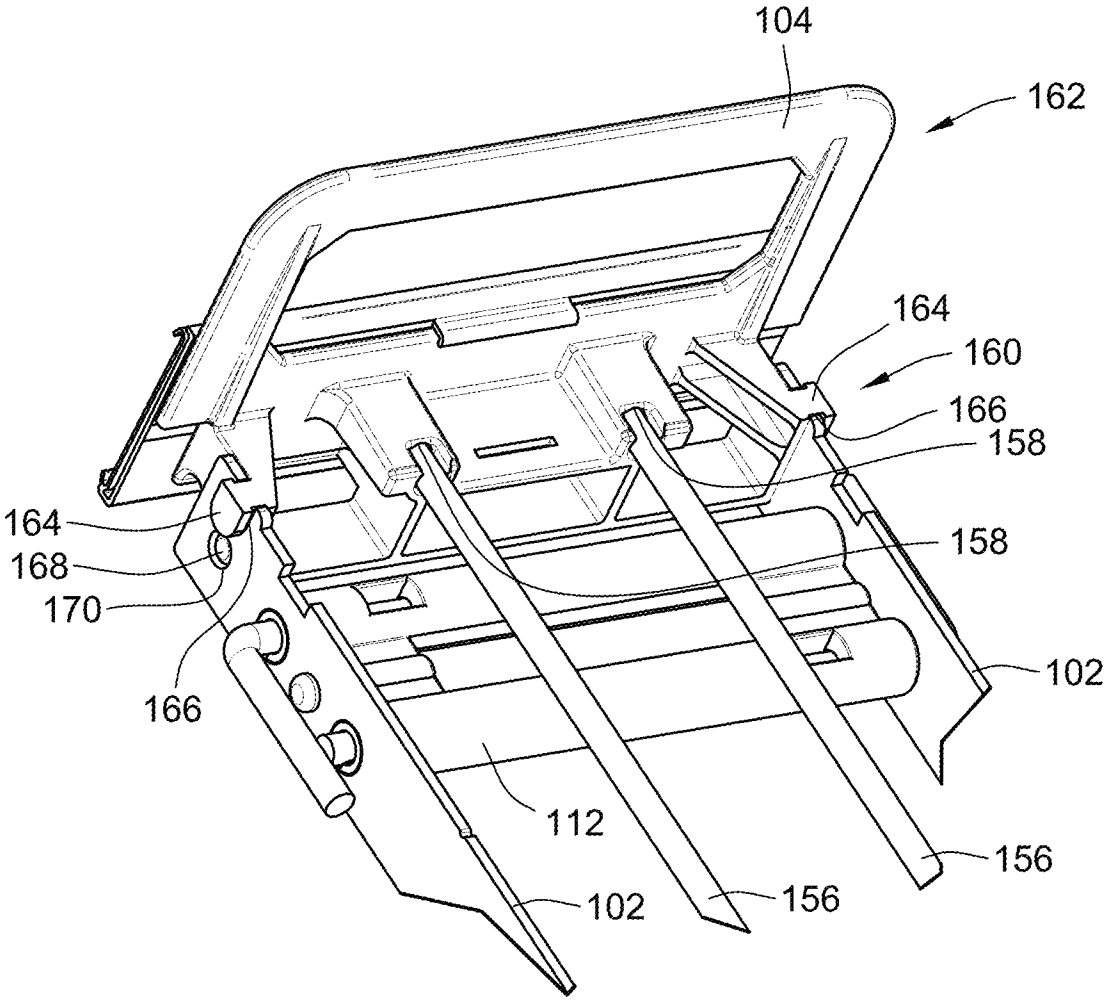
FIG. 5 is a partial perspective of the retail merchandise tray of FIG. 1, illustrating a front stop thereof.

Turning now to FIG. 5, front stop 104 mounts to load bearing members 102 as shown. In particular, front stop 104 includes a mounting portion 160 which extends generally perpendicular to an upright portion 162 as shown. This mounting portion includes laterally extending tabs 164 which are received in corresponding open slots 166 formed in load bearing members 102. These tabs 164 and their corresponding slots 166 are U-shaped such that they cannot rotate relative to one another. This has the advantage of preventing unwanted rotation of front stop 104 relative to load bearing members 102. Additionally, mounting portion 160 may also include protrusions 168 received in corresponding apertures 170 for the same purpose.

Mounting portion 160 also includes pockets 158 within which the terminal ends of longitudinal members 156 are received and supported from an underside thereof. As such, wire support structure 110 is supported at either end, as introduced above.

Figure 6:
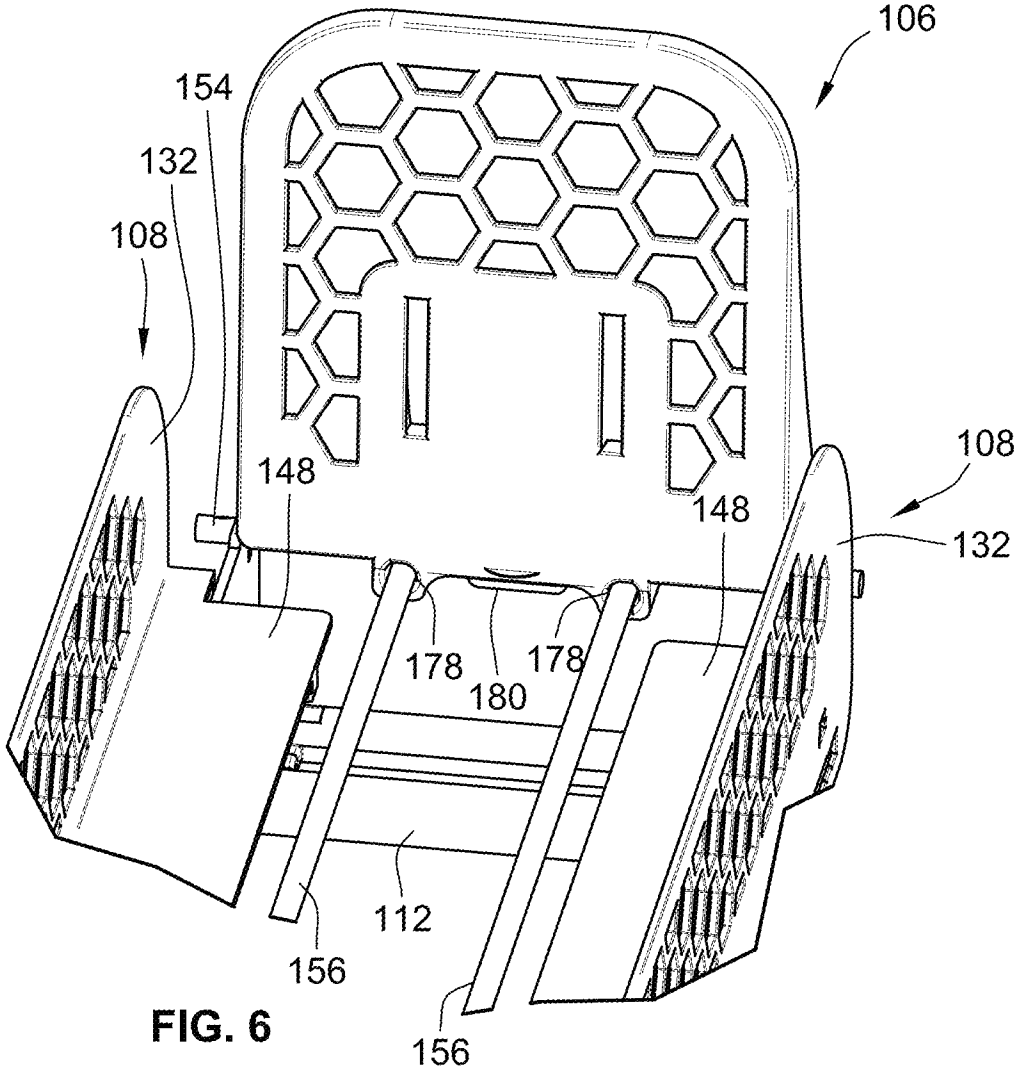
FIG. 6 is a partial perspective view of the retail merchandise tray of FIG. 1, illustrating a pusher thereof.

With reference to FIG. 6, as mentioned above pusher 106 is slidable on wire support structure 110. To this end, pusher 106 includes wire receiving passageways 178 through which longitudinal members 156 extend. As may be surmised from inspection of FIG. 6, pusher 106 is fully supported by wire structure 110. This results in minimal contact of pusher 106 with the remainder of tray 100, thereby reducing or eliminating the likelihood of binding or the like.

Figure 7:
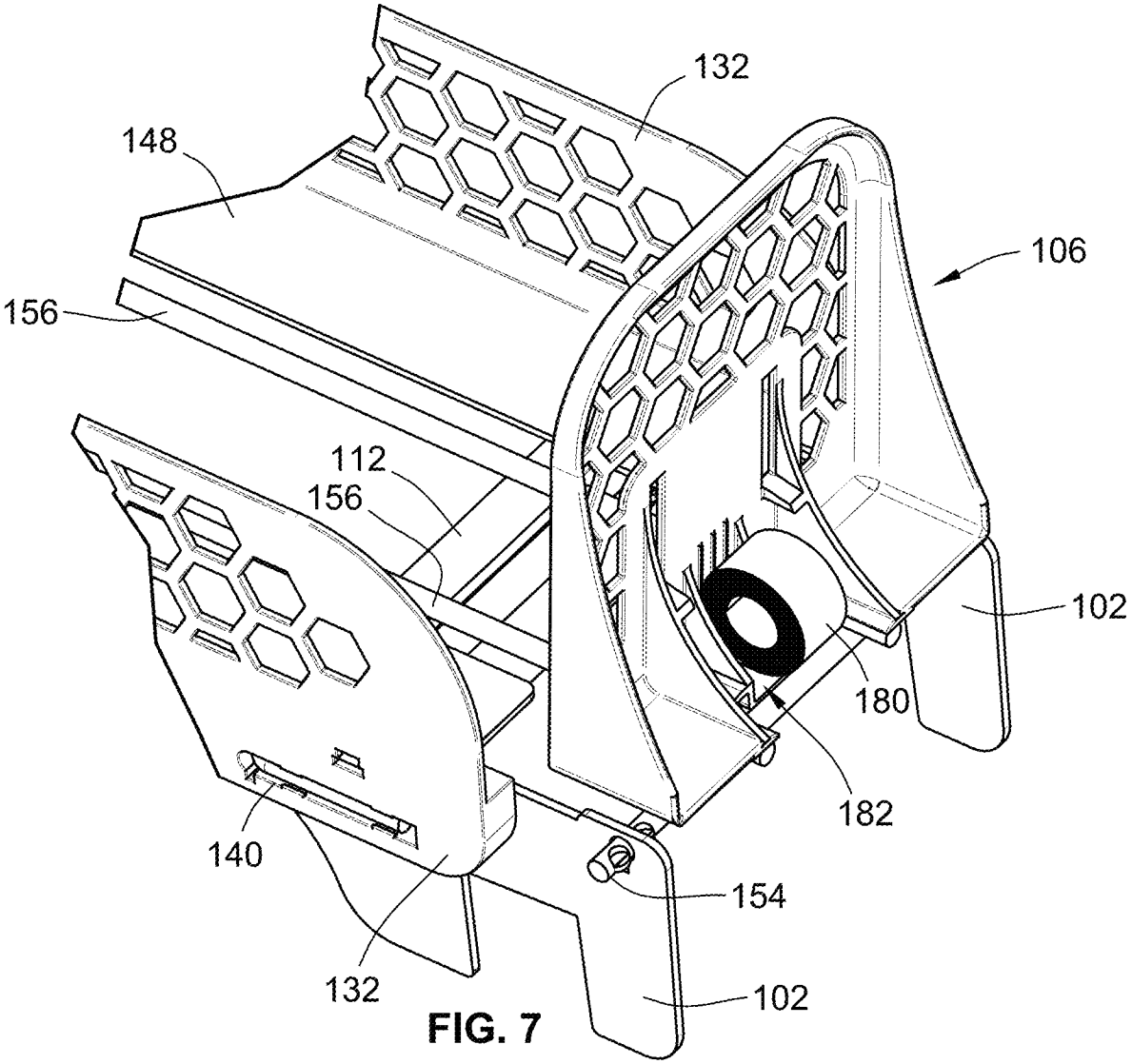
FIG. 7 is another perspective view of the pusher shown in FIG. 6.

A spring opening 182 is also formed through pusher 106 for feeding an uncoiled portion of a coil spring 180 as shown in FIG. 7. This coil spring 180 rests on pusher 106 and its free end passes through opening 180 and connects to front stop 104, or any other portion of tray 100 sufficient to apply a biasing force to pusher 106 to pull it from second end 116 to first end 114 shown in FIG. 1.

Figure 8:
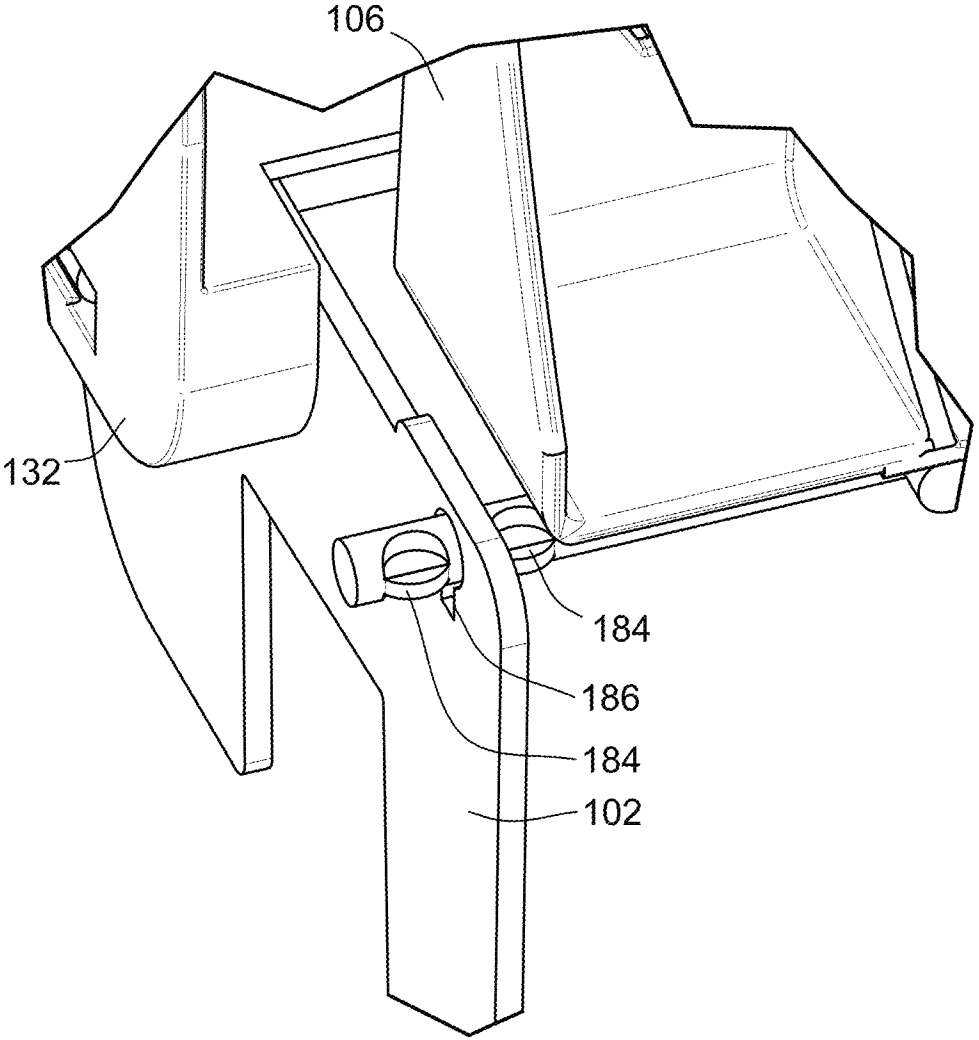
FIG. 8 is a partial perspective view of the retail merchandise tray of FIG. 1, illustrating a removable connection between a wire support structure and a load bearing member of the retail merchandise tray.

Turning now to FIG. 8, lateral member 154 includes keys 184 adjacent the ends of lateral member 154. One end of lateral member 154 and its respective keys 184 are shown in FIG. 8. An identical configuration exists for the other end. These keys are formed and sized such that they may pass through a keyway 186 formed in load bearing members 102.

As shown in the illustrated view, the outer most key 184 has passed through keyway 186 to thereby interpose load bearing member 102 between keys 184. This configuration maintains the lateral positioning of wire support frame 110 relative to load bearing members 102. It is also possible to omit the inner keys 184 at each end of lateral member 154 and use only the outer most keys 184, such that the load bearing 102 are interposed between these outer most keys 184.

Figure 9:
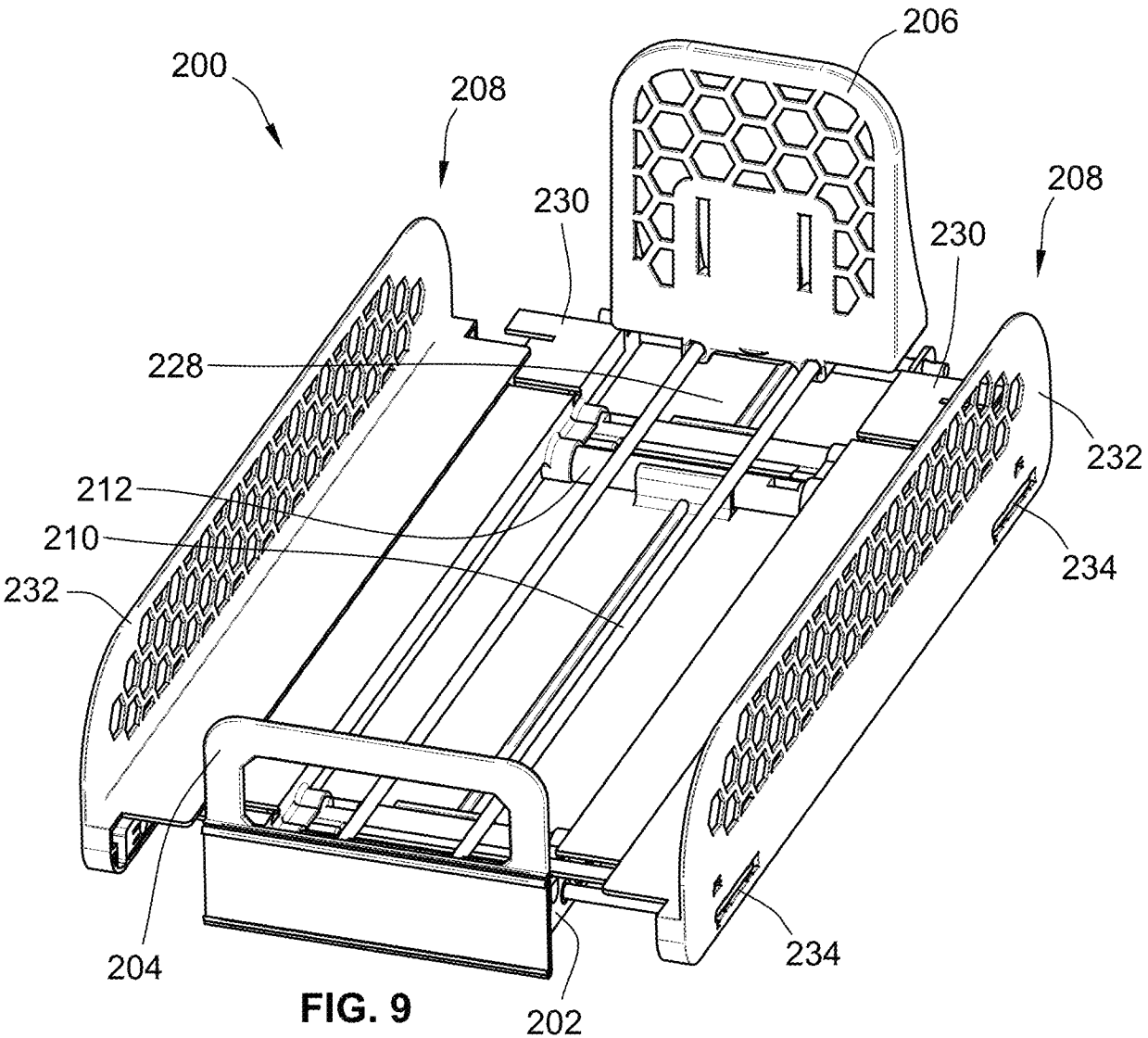
FIG. 9 is partial perspective view of another embodiment the retail merchandise tray of FIG. 1.

Turning now to FIG. 9, an alternate embodiment of tray 100 is shown in the form of tray 200. This embodiment is identical to the embodiment of tray 100 discussed above, except for the following notable differences. Accordingly, and for purposes of brevity, a redundant description of the same structure discussed above is dispensed with.

Indeed, tray 200 also incorporates load bearing members 202, a front stop 204, and pusher 206 and spacers 212 which are identical in form and function as those same components discussed above relative to FIGS. 1-8. However, the divider assemblies 208 have a different construction. These divider assemblies 208 are identical so a description of one applies equally well to the other. Additionally, this embodiment also incorporates a baffle plate 228 along the underside of tray 200.

Figure 10:
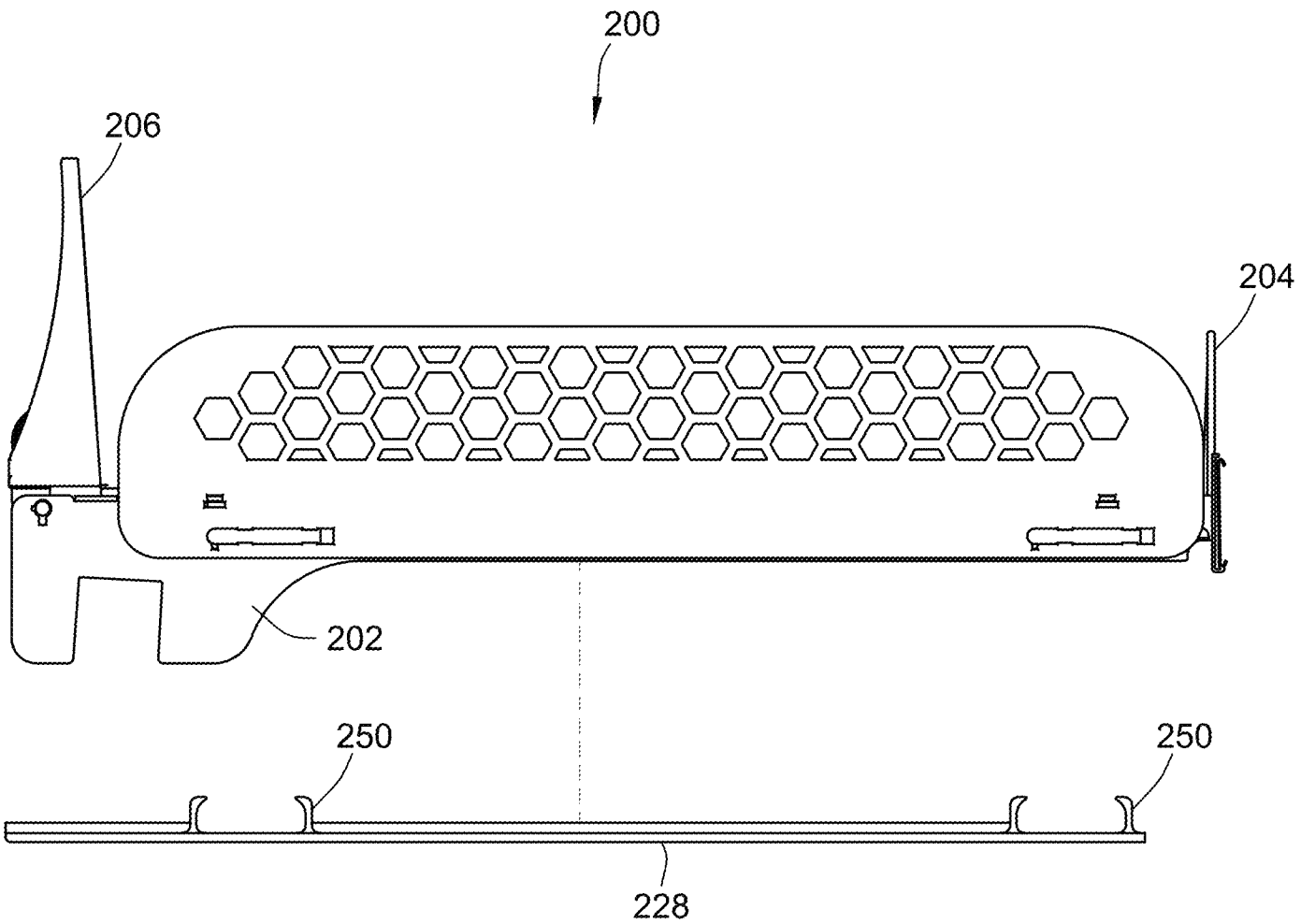
FIG. 10 is a side exploded view of the retail merchandise tray of FIG. 9.

Turning first to the latter of the above two notable differences, baffle plate 238 is removably attached to tray 200. In particular, and with reference to FIG. 10, baffle plate 238 includes resilient clips 250 which clip against spacers 212 as shown with momentary reference back to FIG. 9. This allows baffle plate 238 to be snapped on and off tray 200. As is understood by those of skill in the art, existing baffle plates are typically separate structures from any trays or the like, and typically require their own separate mounting to the back of a retail merchandise display. The instant invention has the advantage of a self contained baffle plate 238 with each tray 200 that is directly mounted thereto.

As is also generally understood in the art, baffle plates are employed to prevent denser cold air in a refrigerated environment from rapidly passing past the upper most trays in a refrigerated case or the like. Such baffle plates typically slow this flow of cold air such that the upper trays and the lower trays are generally exposed to the same amount of cold air. Maintaining this principle in the instant invention, divider assemblies 208 also employ their own baffle plate extension such that when divider assemblies 208 are extended, a continuous baffle plate surface is presented across the width of tray 200. This configuration provides the same advantage of slowing or preventing the undesirable flow of cold air past tray 200, but has the advantage of a self-contained baffle arrangement as mentioned above.

Figure 11:
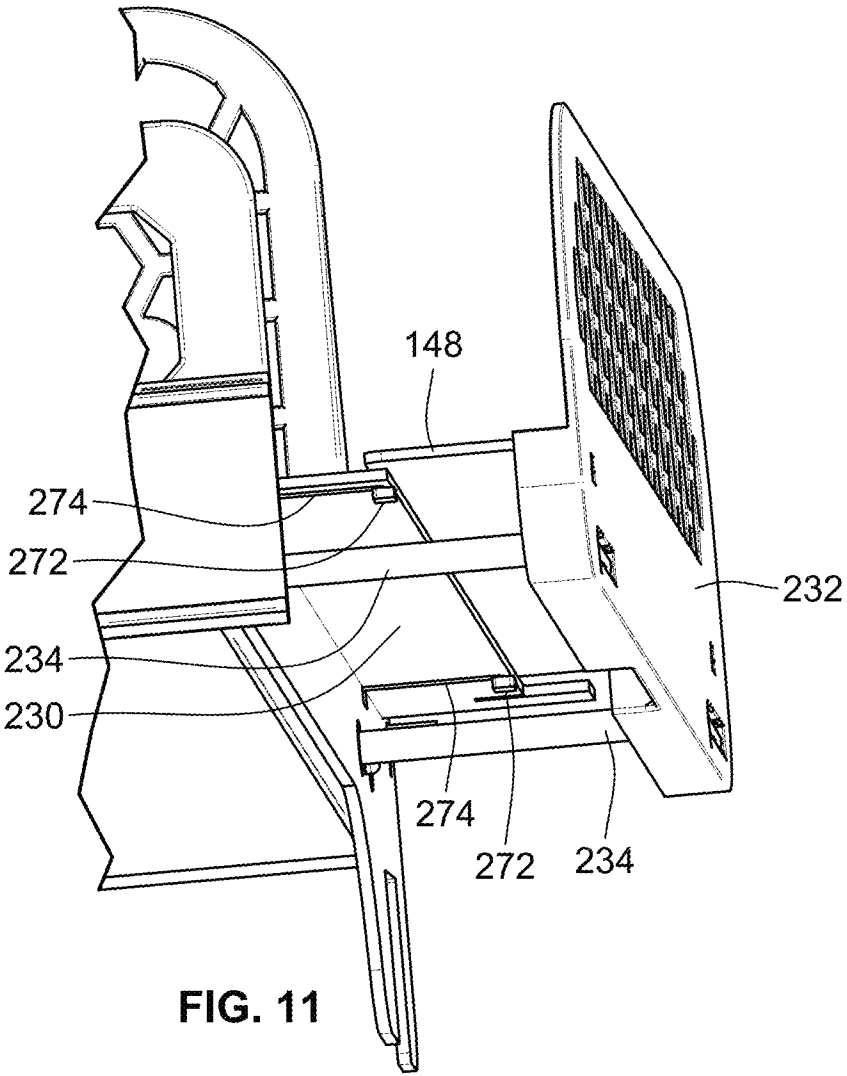
FIG. 11 is partial perspective view of a divider assembly of the retail merchandise tray of FIG. 9, illustrating a slidable connection between a divider wall and a baffle plate extension of the divider assembly.

To this end, and turning now to FIG. 11, each divider assembly 208 includes a divider wall 232 attached to wire supports 234 in the same manner as discussed above. However, divider assembly also includes a baffle plate extension 230. A slidable connection is formed between baffle plate extension 230 and flange 248 of divider wall 232. This slidable connection is in the form of a tab 272 on flange 248 which depends downwardly into a corresponding slot 274 formed into the baffle plate extension. As a result, flange 248 and baffle plate extension 230 form a continuous baffle plate surface as shown.

Figure 12:
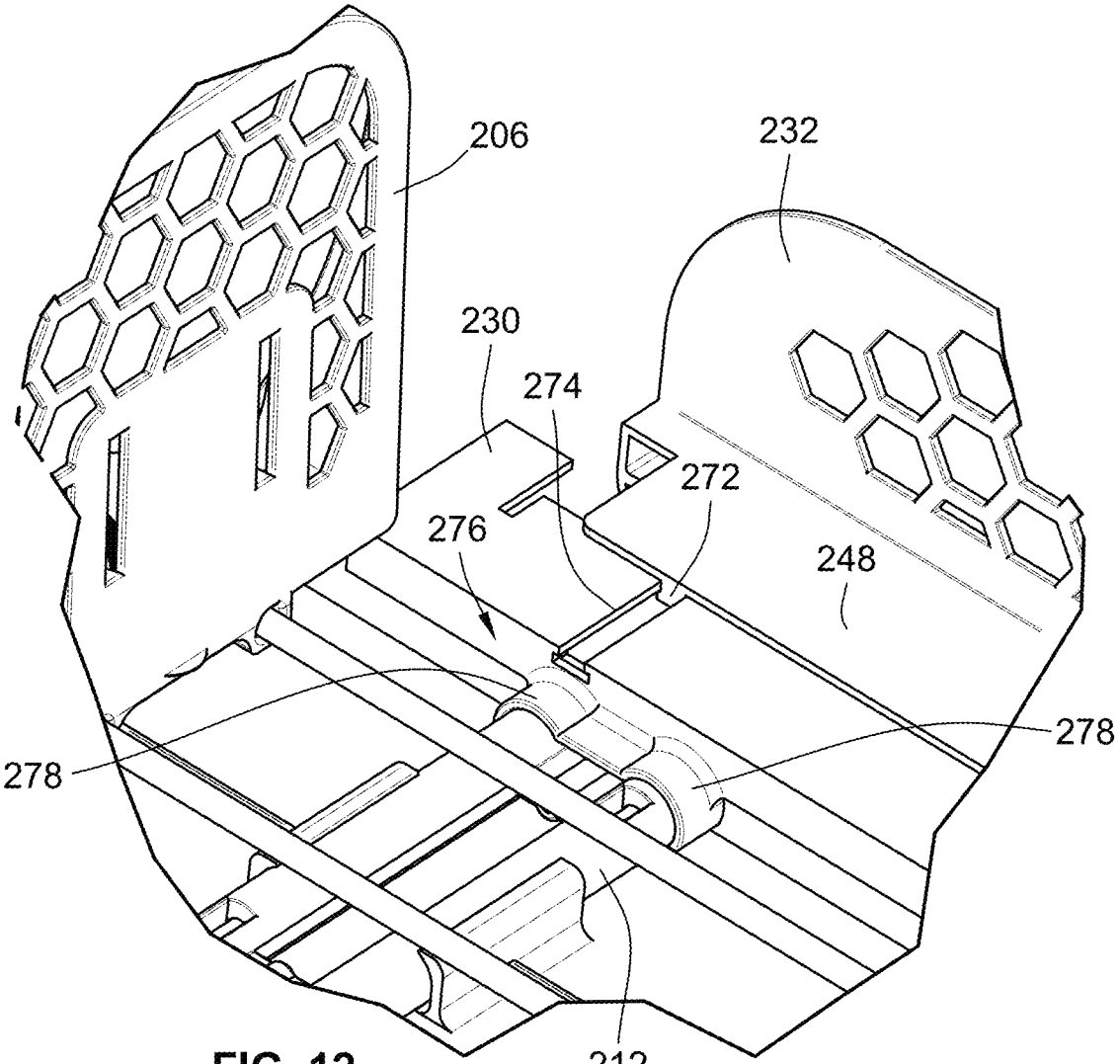
FIG. 12 is a partial perspective view of the divider assembly shown in FIG. 11, illustrating a slidable connection between the baffle plate extension and a spacer of the retail merchandise tray.

Turning now to FIG. 12, baffle plate extension connects to spacers 212 via slidable connection as well. As a result, pulling divider wall 232 away from tray 200 causes tab 272 to slide within slot 274 until it reaches the position shown in FIG. 11. Thereafter, continued movement of divider wall 232 laterally away from tray 200 then causes baffle plate extension 230 to slide along spacers 212 to allow baffle plate extension 230 to move laterally outward as well to the position shown in FIG. 11.

Still referring to FIG. 12, this slidable connection of baffle plate extension 230 relative to spacers 212 is formed by slidable clips 276. These clips 276 include rounded portions 278 which clip partially around corresponding rounded portions of spacers 212. As such, the baffle plate extensions are affixed to but slidable along spacers 212.

Figure 13:
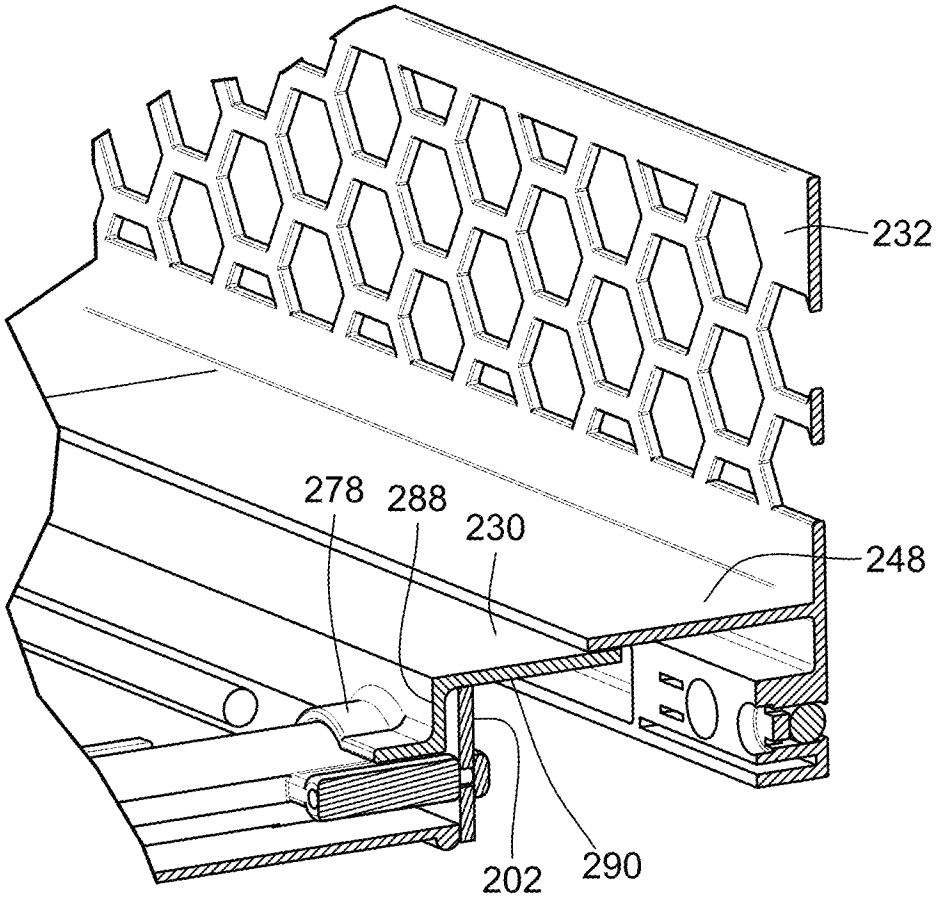
FIG. 13 is perspective cross section taken in the region of the slidable connection between the baffle plate extension and the spacer.

Turning now to FIG. 13, laterally outward movement of each baffle plate extension 230 continues until a downwardly depending extension portion 288 of baffle plate extension 230 which depends generally perpendicular from a support portion 290 of baffle plate extension 230 abuts load bearing member 202 as shown.

Figure 14:
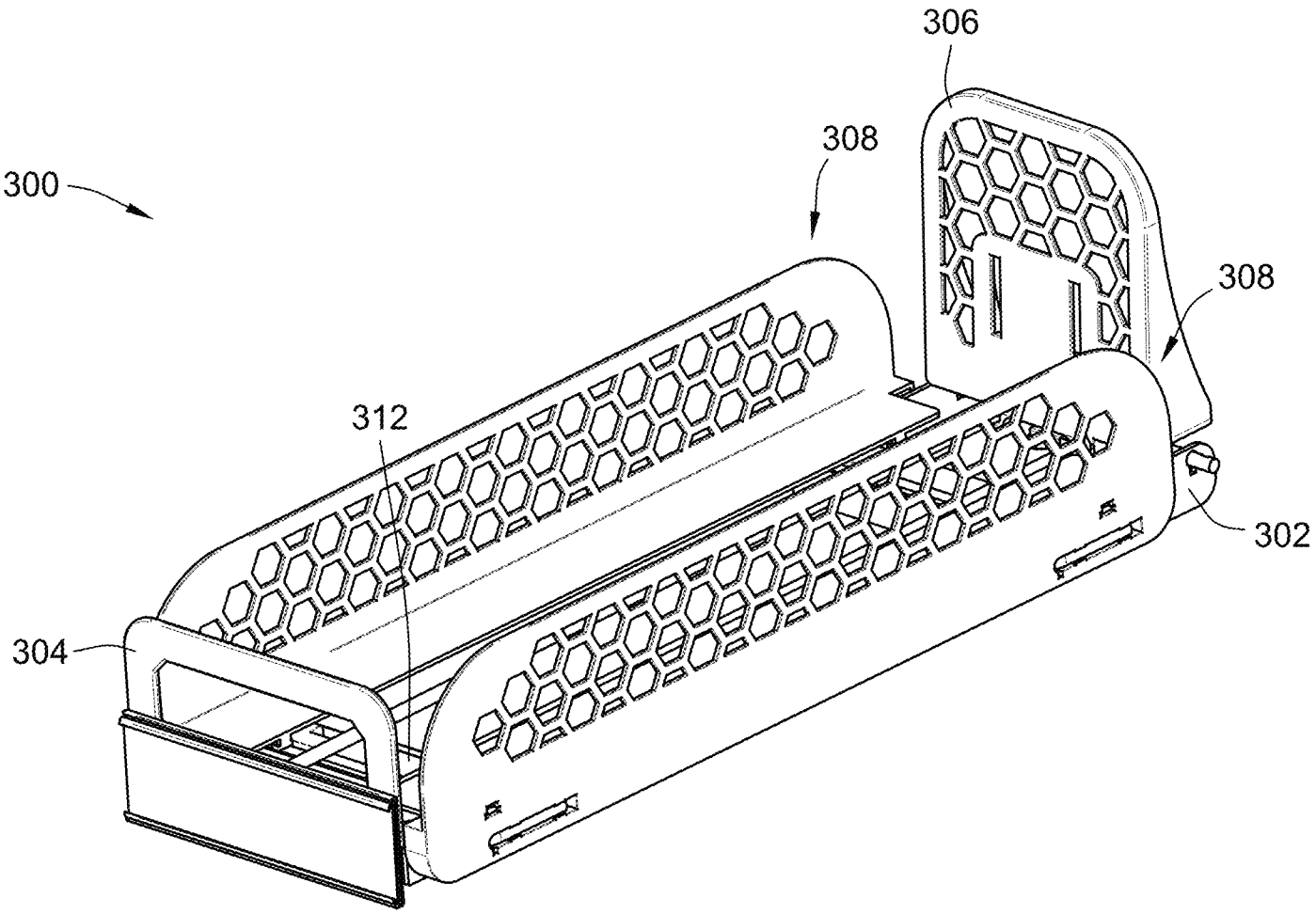
FIG. 14 is a perspective view of another embodiment of the retail merchandise tray according to the teachings herein.

With reference to FIG. 14, the same illustrates a tray 300 which is identical to tray 100 except that it utilizes load bearing members 302 of a different design, and a shelf mounting arrangement for situating tray 300 directly on the surface of a retail shelf. Each of these features will be discussed in turn.

As stated above, the remainder of tray 300 is identical to tray 100 discussed previously, and as such, a redundant detailed description of identical features is dispensed with for purposes of brevity. Indeed, tray 300 also includes, a front stop 304, a pusher 306, divider assemblies 308, a wire support structure 310, and a pair of spacers 312 (see FIG. 15) each of which is identical to those same structures discussed above relative to tray 100.

Load bearing members 302, however, no longer utilize a cut-out such as cut-out 118 shown in FIG. 1. Instead, load bearing members 302 have generally flat bottoms so that they may sit directly on a shelf. As previously mentioned, tray 300 also incorporates a shelf mounting arrangement for fixing tray 300 on to a retail shelf.

Figure 15:
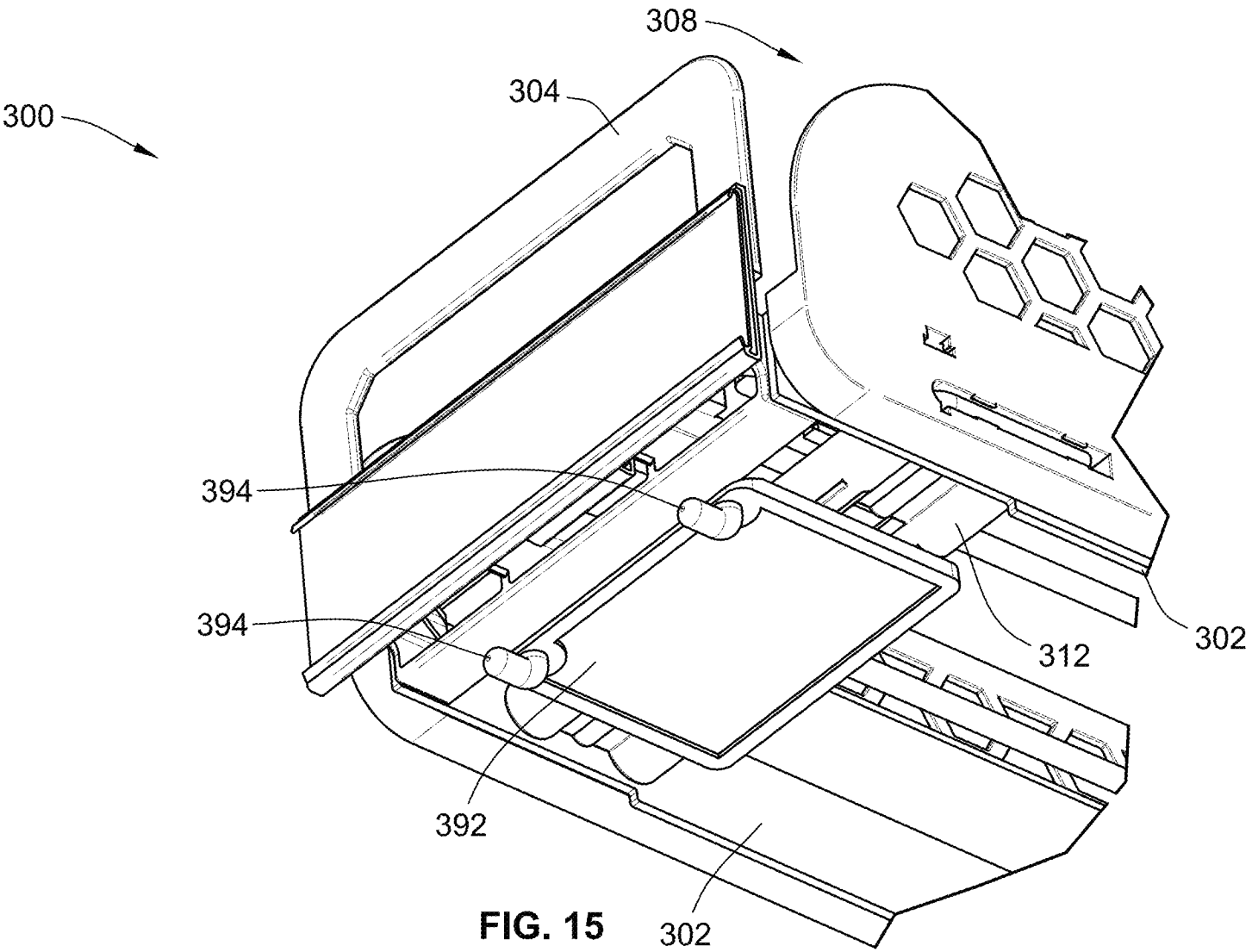
FIG. 15 is a partial perspective view of a shelf mounting arrangement of the retail merchandise tray of FIG. 14, in the form of a mounting plate.

One embodiment of such a shelf mounting arrangement is shown in FIG. 15. This embodiment includes a mounting plate 392 which clips onto the front most spacer 312 of tray 300. Mounting plate 392 includes a pair of extensions 394 which have a general hook shape and are configured to extend into apertures formed in a retail shelf.

Figure 16:
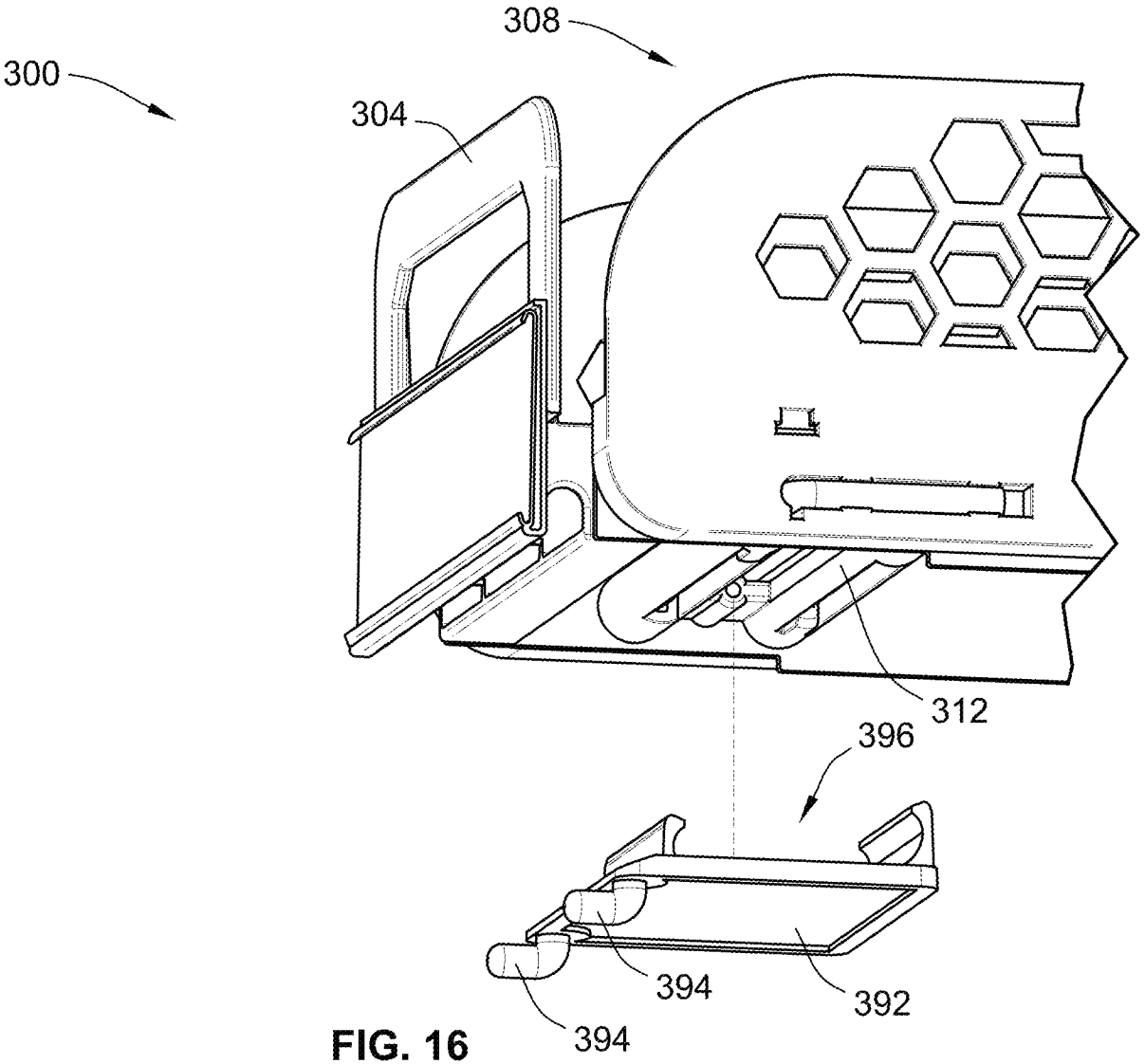
FIG. 16 is a perspective exploded view of the mounting plate of FIG. 15.
Figure 17:
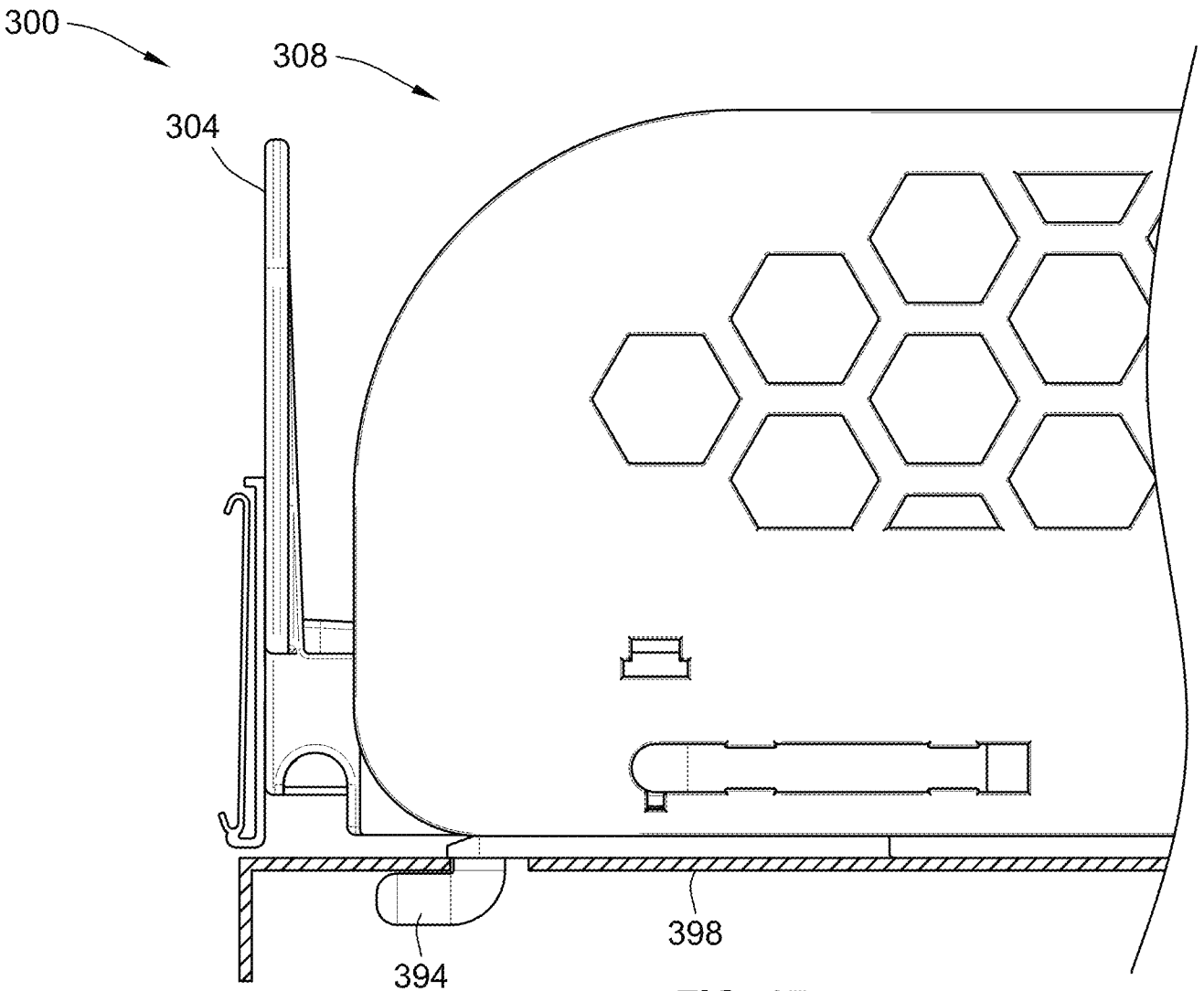
FIG. 17 is a partial side view of the retail merchandise tray of FIG. 14, illustrating the mounting plate mounting the retail merchandise tray to a shelf.

With reference to FIG. 16, mounting plate 392 employs a clip 396 similar to those clips described above for removably attaching mounting plate 392 to spacer 312. Although two extensions 394 are illustrated fewer or greater extensions may be employed. FIG. 17 illustrates tray 300 mounted to a shelf 398. As may be seen in this view, extensions 394 extend through apertures in the shelf to fix tray 300 to shelf 398.

Figure 18:
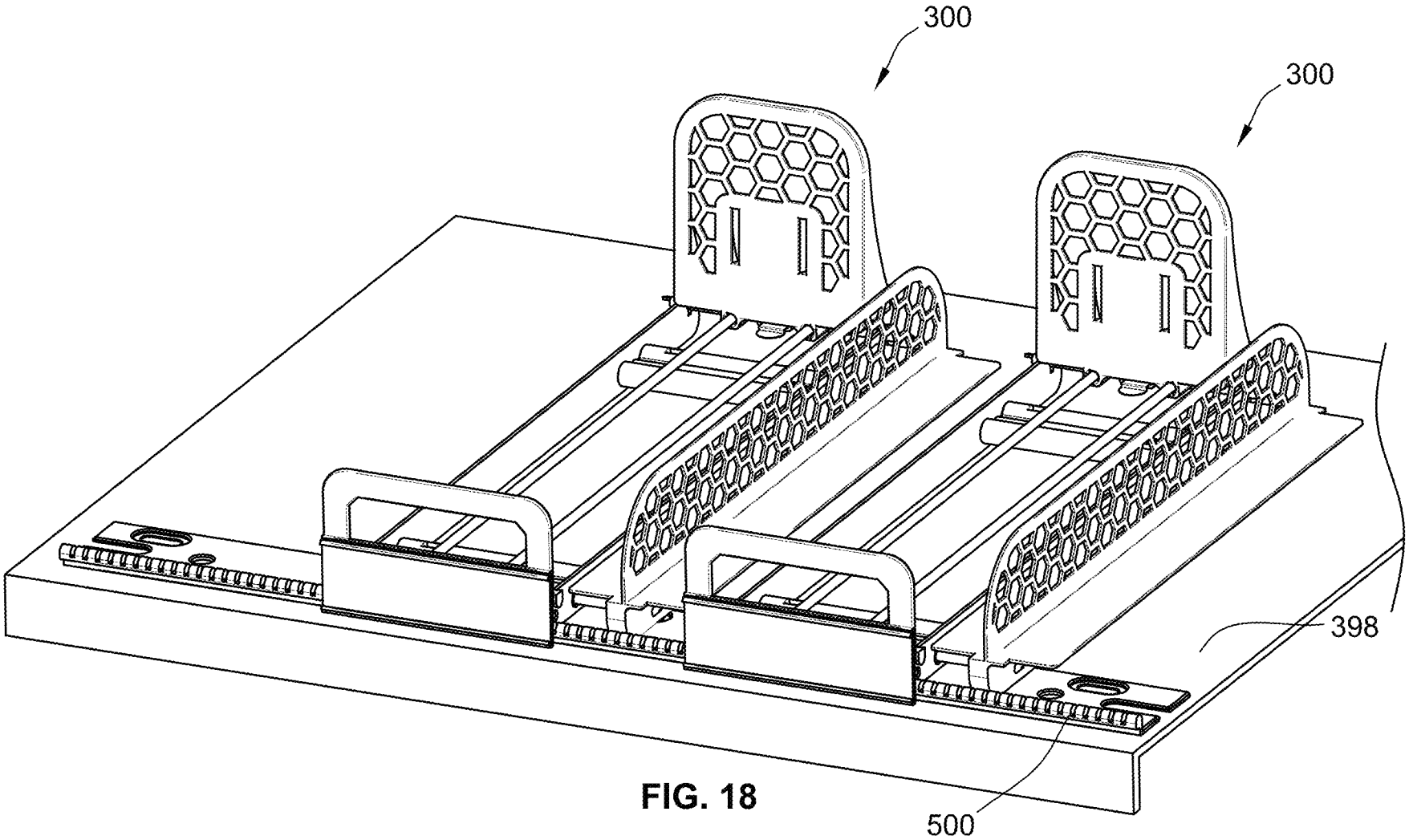
FIG. 18 is a perspective view of another embodiment of a shelf mounting arrangement of the retail merchandise tray, illustrating multiple retail merchandise trays such as those as shown in FIG. 14, mounted to a mounting rail which receives at least one mounting tab.

FIG. 18 illustrates another embodiment of a shelf mounting arrangement. In this embodiment, multiple trays 300 are mounted to a mounting rail 500, which is in turn mounted directly to shelf 398. As explained below, each tray 300 snaps into mounting rail 500 to fix the tray 300 to shelf 398. Although two trays 300 are shown, mounting rail 500 may be of any length to accommodate a greater number of trays 300.

Figure 19:
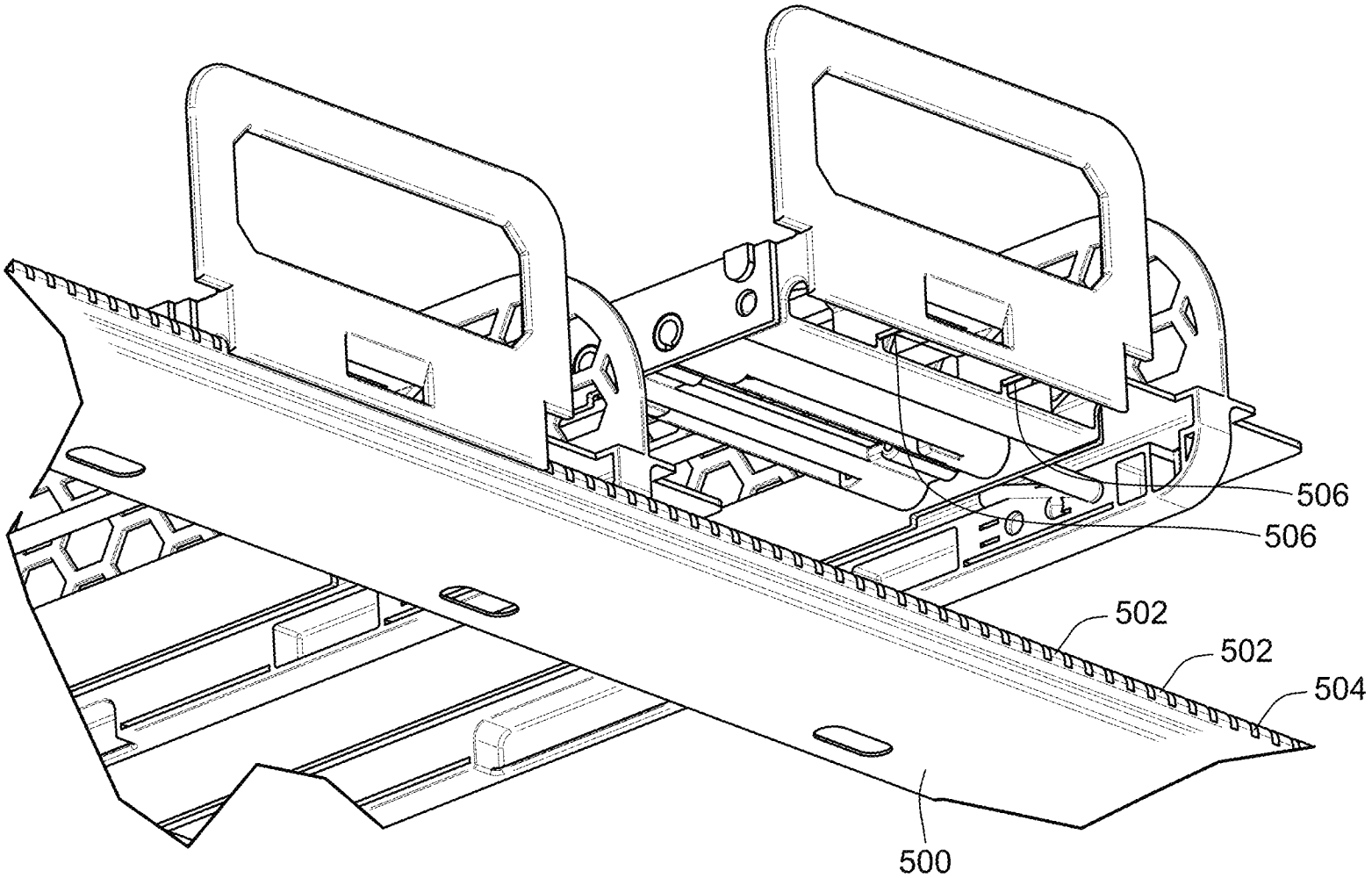
FIG. 19 is a perspective exploded view, illustrating one of the retail merchandise trays of FIG. 18 disconnected from the mounting rail to expose at least one mounting tab of the retail merchandise tray which is received between adjacent teeth of the mounting rail.

FIG. 19 illustrates one of the trays 300 exploded away from mounting rail 500. As can be seen in this view, mounting rail 500 includes a plurality of teeth 502, with a space formed between each adjacent set of teeth. These spaces 504 are configured to receive a tab 506 formed on front stop 304. In the illustrated embodiment, two tabs 506 are utilized, but fewer or greater tabs 506 may be employed. The width of each tab 506 is such that it will tightly fit in each space 504. As a result, tray 300 may be removably attached to mounting rail 500.

Figure 20:
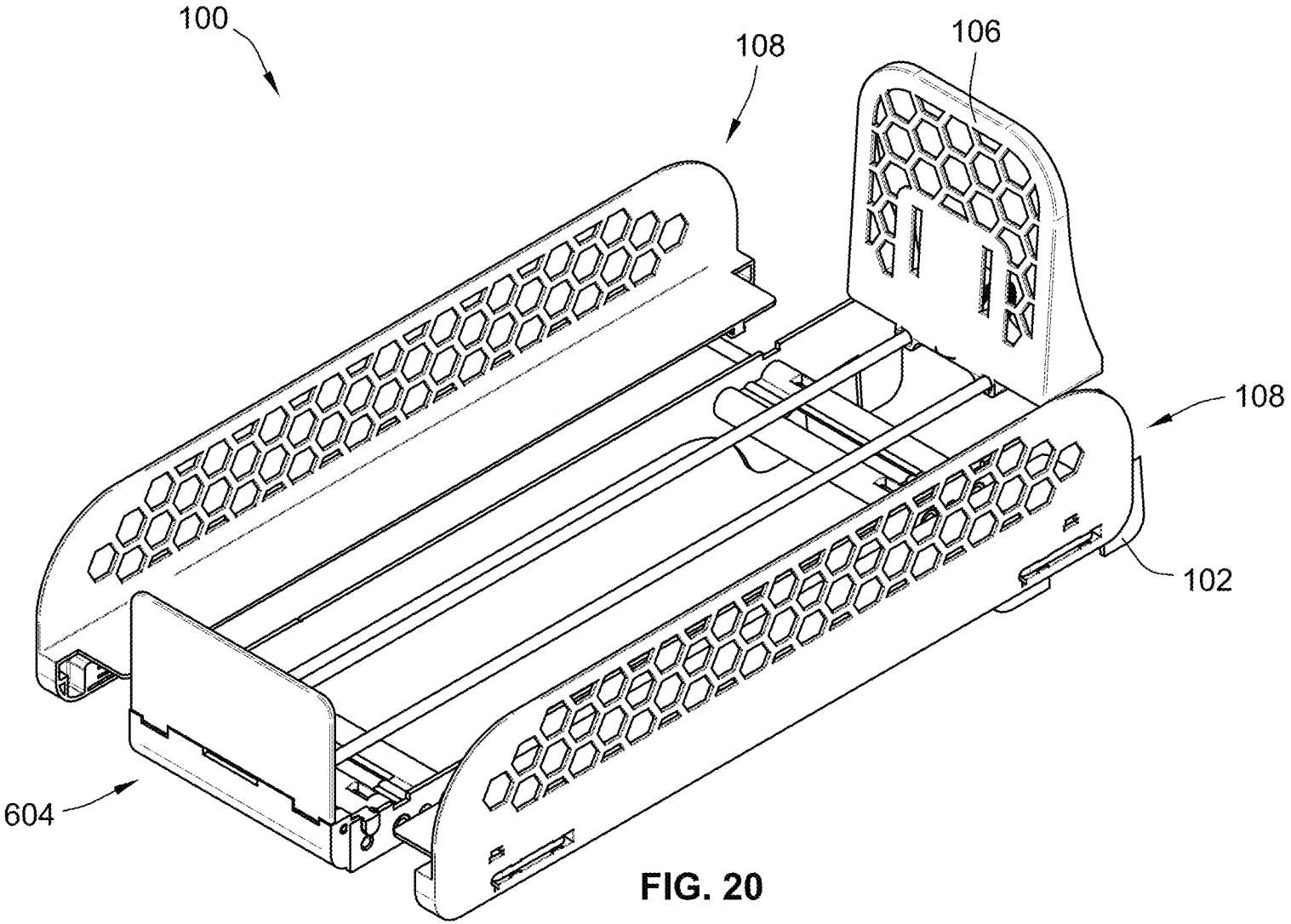
FIG. 20 is a perspective view of the retail merchandise tray of FIG. 1 utilizing a foldable front stop, illustrating a foldable front stop in its operational position.
Figure 21:
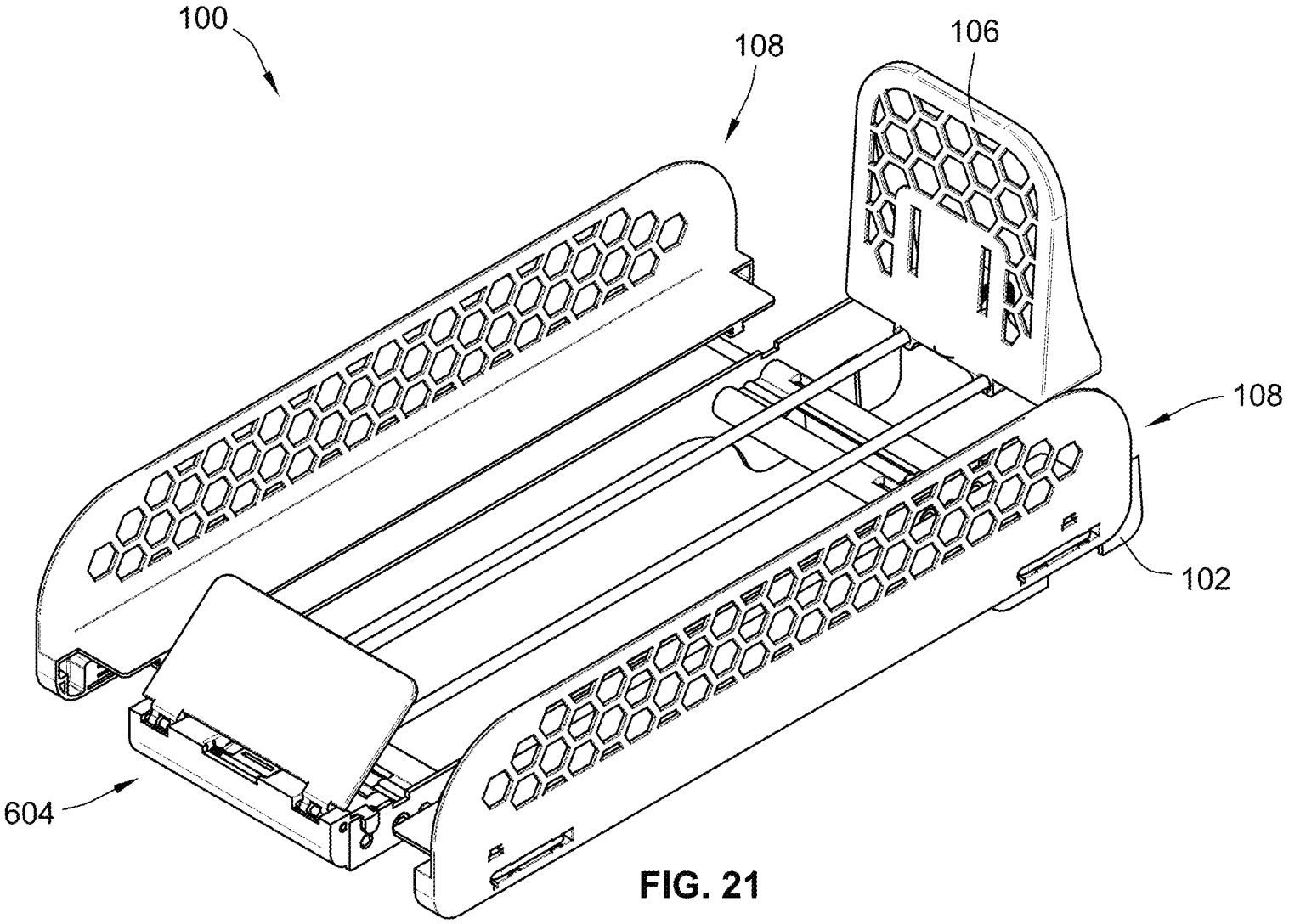
FIG. 21 is a perspective view of the retail merchandise tray of FIG. 20, illustrating the foldable front stop transitioning from its operational position to a loading position.

FIG. 20 illustrates tray 100 from FIGS. 1-8 utilizing a different embodiment of a front stop 604. This front stop 604 is foldable from an operational position shown in FIG. 20 to a loading position shown in FIG. 21. As can be seen in FIG. 21, in the loading position, front stop 604 is rotated to a generally flat presentation to allow retail merchandise to be loaded onto tray 100 from the front end 114 (see FIG. 1) thereof. This presents a significant advantage over other designs with non-folding front stops, because in those designs merchandise is typically loaded from the rear of the tray, or is difficult to load from the front due to the non-folding front stop obscuring the loading path.

Figure 22:
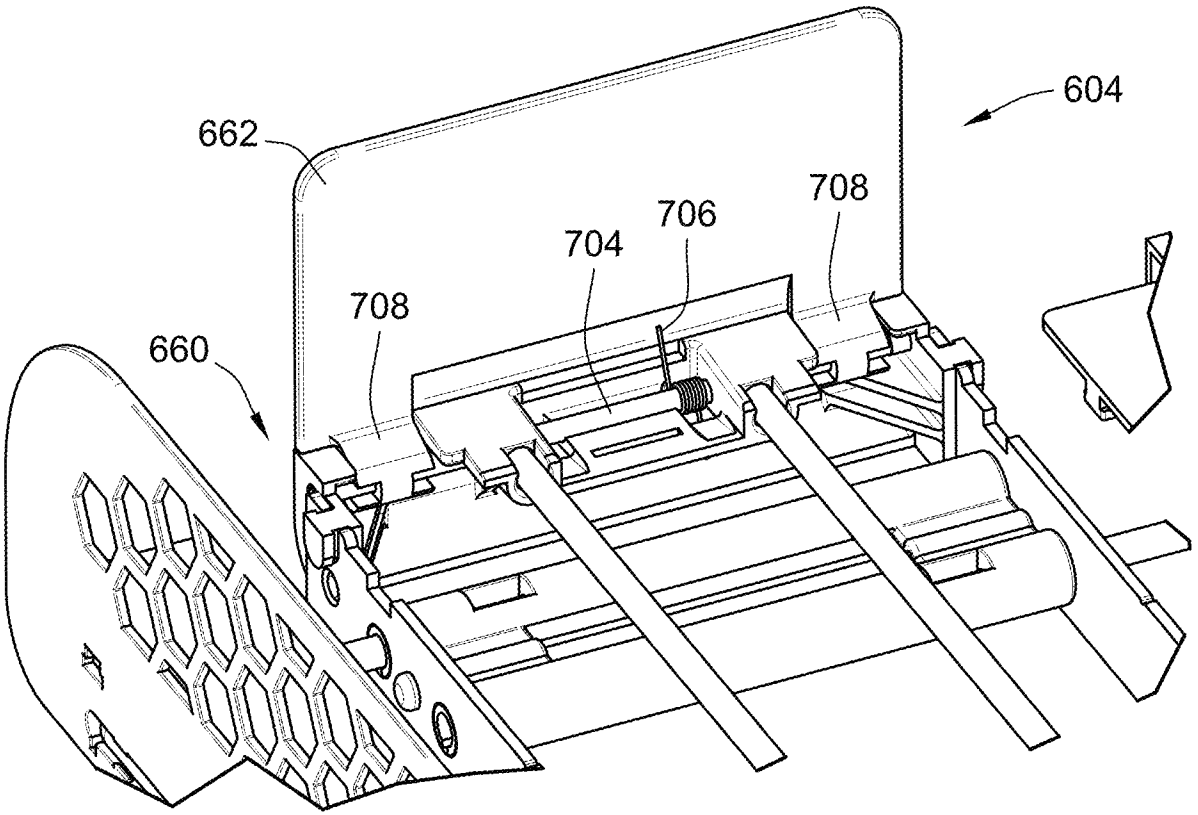
FIG. 22 is a partial perspective view of the foldable front stop shown in FIGS. 20-21.

FIG. 22 illustrates the rear side of front stop 604. Front stop 604 includes a mounting portion 660 and an upright portion 662. However, unlike front stop 104, these portions 660, 662 are not integrally formed. Instead, mounting portion 660 is separate from upright portion 662 and a hinge is formed between these components. Indeed, a hinge pin 704 extends through mounting portion 660 and is received by hinge lugs 708 on upright portion 662. Upright portion 662 may rotate about hinge pin 704 relative to mounting portion 660. A spring 706 is also associated with hinge pin 704, and exerts a biasing force against upright portion 662 to maintain it in its upright position. This biasing force may be overcome by pushing against the front face of upright portion 662, causing the same to rotate about hinge pin 704. This configuration has the advantage of allowing high speed loading of tray 100. It should be noted that although front stop 604 is illustrated with tray 100, front stop 604 may be utilized with any of the trays described herein.

Figure 23:
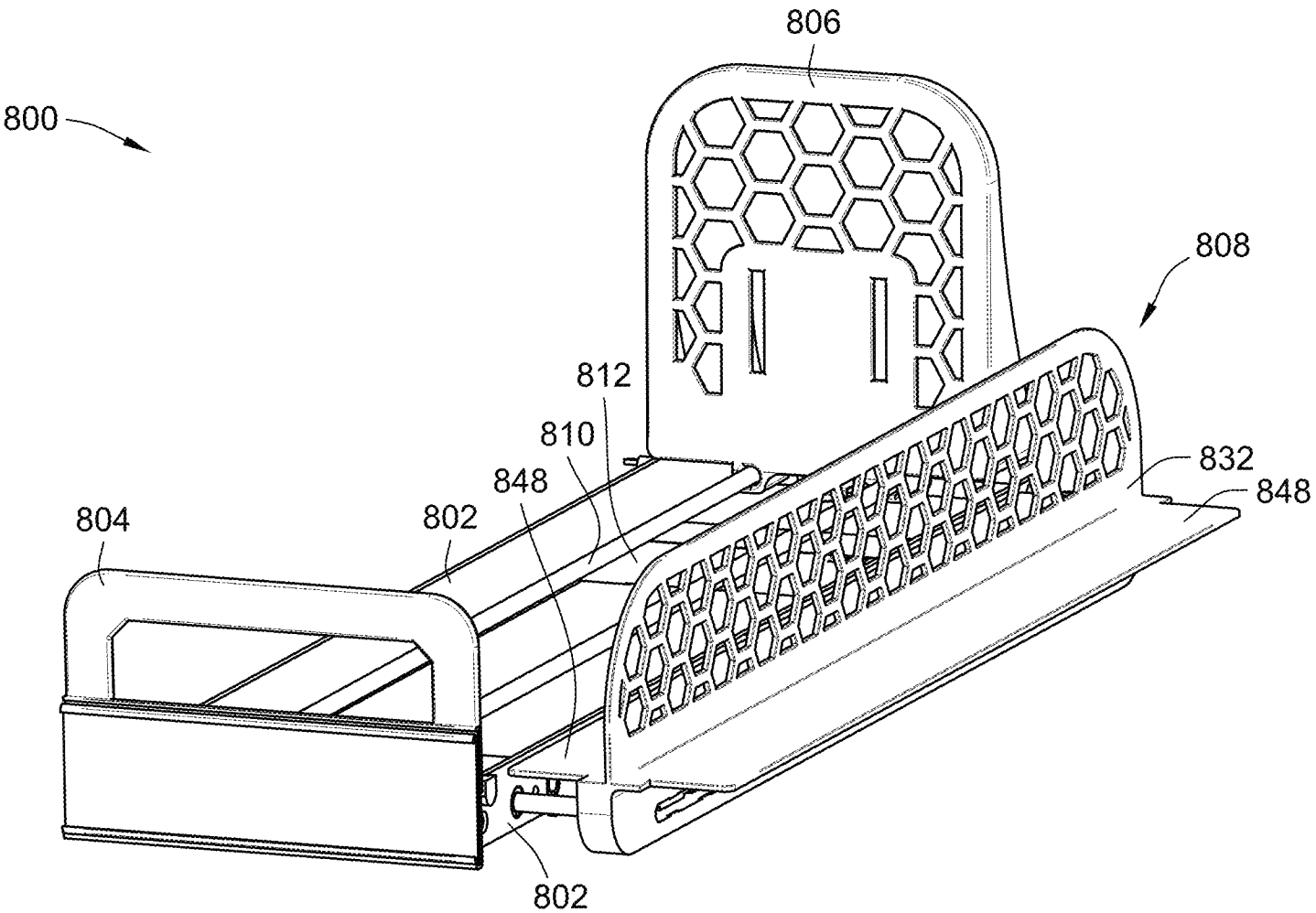
FIG. 23 is a perspective view of the retail merchandise tray of FIG. 1, utilizing an alternative embodiment of a divider wall assembly.

FIG. 23 illustrates another embodiment of a tray 800. This tray is identical to those trays described above in that it includes a pair of load bearing members 802, a front stop 804, a pusher 806, a wire support structure 810, and a divider assembly 808. The key difference with tray 800 over those described above is that it utilizes only a single divider assembly 808. This divider assembly 808 is substantially the same as those described above in that it includes a divider wall 832 removably attached to wire supports 834 as shown.

However, because only a single divider assembly 808 is used, it is configured to be shared with an adjacent tray (not shown) having only a single divider as well. Put differently, divider wall 832 is shared between two adjacent trays 800. To this end, divider wall 832 has flanges 848 extending from both sides thereof. This allows divider wall 832 to support merchandise on tray 800 shown, as well as the adjacent tray 800 (not shown). Furthermore, although not illustrated, it is also conceivable that this single divider wall may be connected to two baffle plate extensions such as those described above relative to tray 200. In such a configuration, flanges 848 would also include tabs such as those described above to achieve a slidable connection with baffle plate extensions. More generally, this single divider assembly configuration may be employed on any of the trays described herein.

As discussed in the preceding, trays according to the teachings herein present various advantages over existing configurations, for example, a lighter and less labor intensive assembly process, an integrated baffle plate configuration which may readily adapt to movement of the divider walls of the trays, an intuitive shelf mounting arrangement, a foldable front stop arrangement, and a single divider assembly arrangement which may be shared between trays, to name only a few.

Turning now to FIGS. 24-28, an alternate embodiment of a tray 900 is shown. This embodiment is identical to those trays discussed above, except for the following notable differences. Accordingly, and for purposes of brevity, a redundant description of the same structure discussed above is dispensed with.

Indeed, tray 900 also incorporates load bearing members 902, a front stop 904, a pusher 906, and spacers 912 which are identical in form and function as those same components discussed above, except for the following notable differences. First, load bearing members 902 do not provide downwardly opening cutouts for mounting tray 900 onto a retail merchandise support bar. Instead, these cutouts are integrated directly into a movable baffle plate 928, which like the above-discussed baffle plate is also movable. Further, this embodiment also incorporates a pusher locking mechanism with an integrated unlocking capability. Additionally, dividers 908 incorporate baffle plate extensions which are the same as those discussed above. As a result, these baffle plate extensions of dividers 908 as well as the movable baffle plate 928 provide the same baffle functionality as that discussed above.

Figure 24:
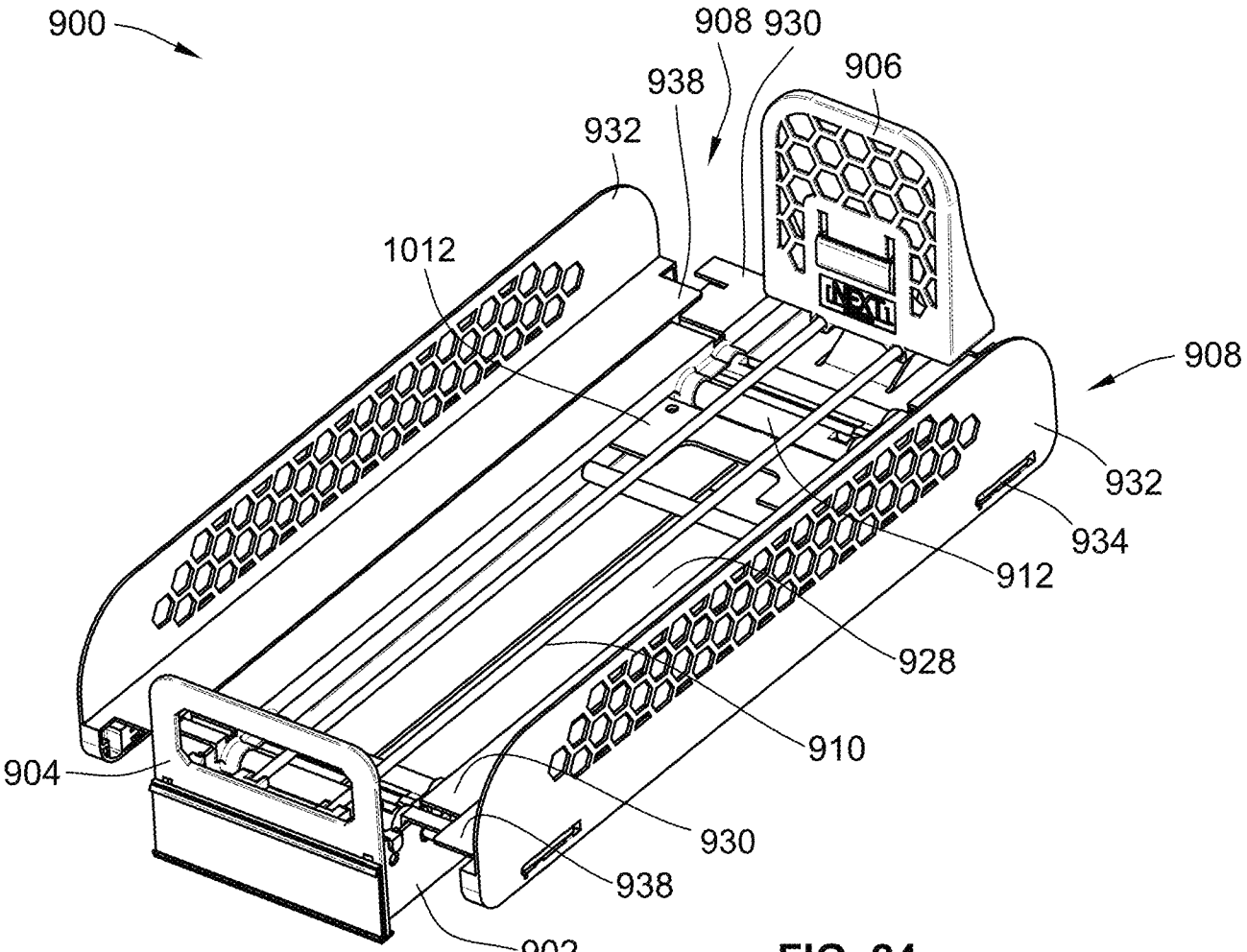
FIG. 24 is a perspective view of another embodiment of a retail merchandise tray according to the teachings herein.

Indeed, and with particular reference to FIG. 24, pusher 906 is slidably mounted to wire support frame 910. A front stop 904 is disposed generally at a front end of the tray and pusher 906 is movable toward and away from the front stop 904 in the same manner as that discussed above. Load bearing members 902 provide structural support to tray 900 and also provide mounting locations for spacers 912 as well as wire support structure 910.

Divider assemblies 908 include divider walls 932 which are attached to wire supports 934 in the same manner as discussed above. A baffle plate extension 930 is slidably connected to a flange 938 of each divider assembly 908 in the same manner as discussed above. It should be noted, however, that these baffle plate extensions 930 are not required. Indeed, tray 900 could be provided with baffle plate 928 alone.

In FIG. 24, tray 900 is shown in a first position wherein it has a first longitudinal length which may be taken from front stop 904 to the opposite longitudinal end of tray 900. In this position, tray 900 is configured to readily dispense retail merchandise in the same manner as that described above.

Figure 25:
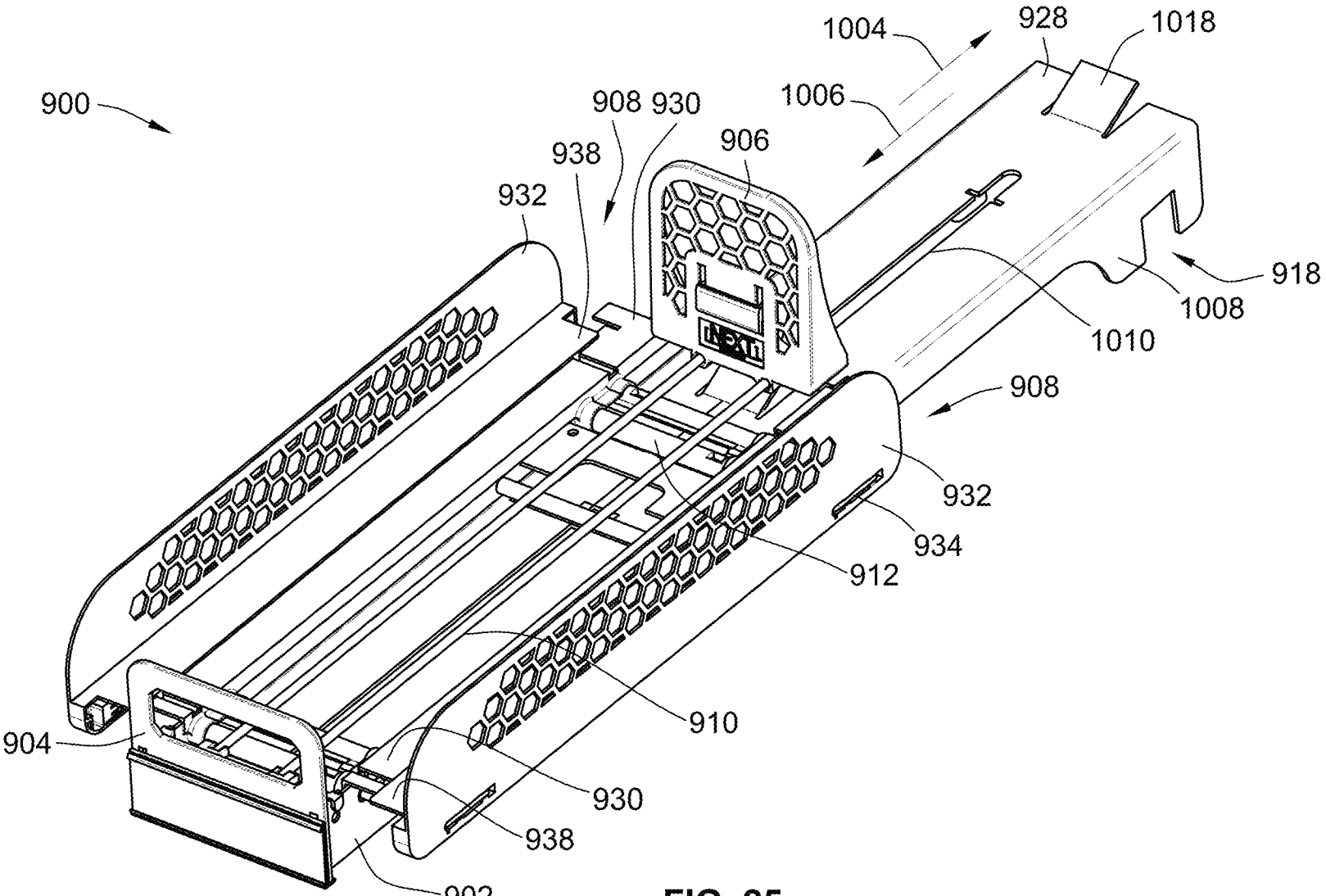
FIG. 25 is a perspective view the embodiment of FIG. 24 in an extended position.

However, as shown in FIG. 25, tray 900 has a second position wherein tray 900 has a second longitudinal length which is longer than the first longitudinal length. In this position, baffle plate 928 has slidably moved relative to load bearing members 902 (and indeed the remainder of tray 900). This sliding or pullout functionality advantageously allows tray 900 to be slid forward when it is time to reload tray 900. This is particularly helpful where tray 900 is mounted in a rack system with other shelving or other trays above and below it. In such an instance, access to tray 900 for reloading the same is generally limited and difficult due to the obstruction above the tray by other shelving or trays. As such, being able to draw tray 900 forward to expose a substantial amount if not the entirety of wire support structure 910 allows for rapid reloading of tray 900. This rapid reloading is facilitated to an even greater extent when taking into account the pusher locking mechanism which is described below.

Baffle plate 928 includes a pair of downwardly depending side walls 1008 each of which incorporate their own downwardly opening notch or cutout 918. Side walls 1008 are sized and spaced so that they are in sliding contact with the interior surfaces of load bearing members 902. Baffle plate 928 also includes an elongate slot 1010 which receives a downwardly extending tab 1014 (see FIG. 26) which depends from a tab plate 1012. This tab and slot configuration limits the sliding movement of baffle plate 928 in linier directions 1004, 1006.

Figure 26:
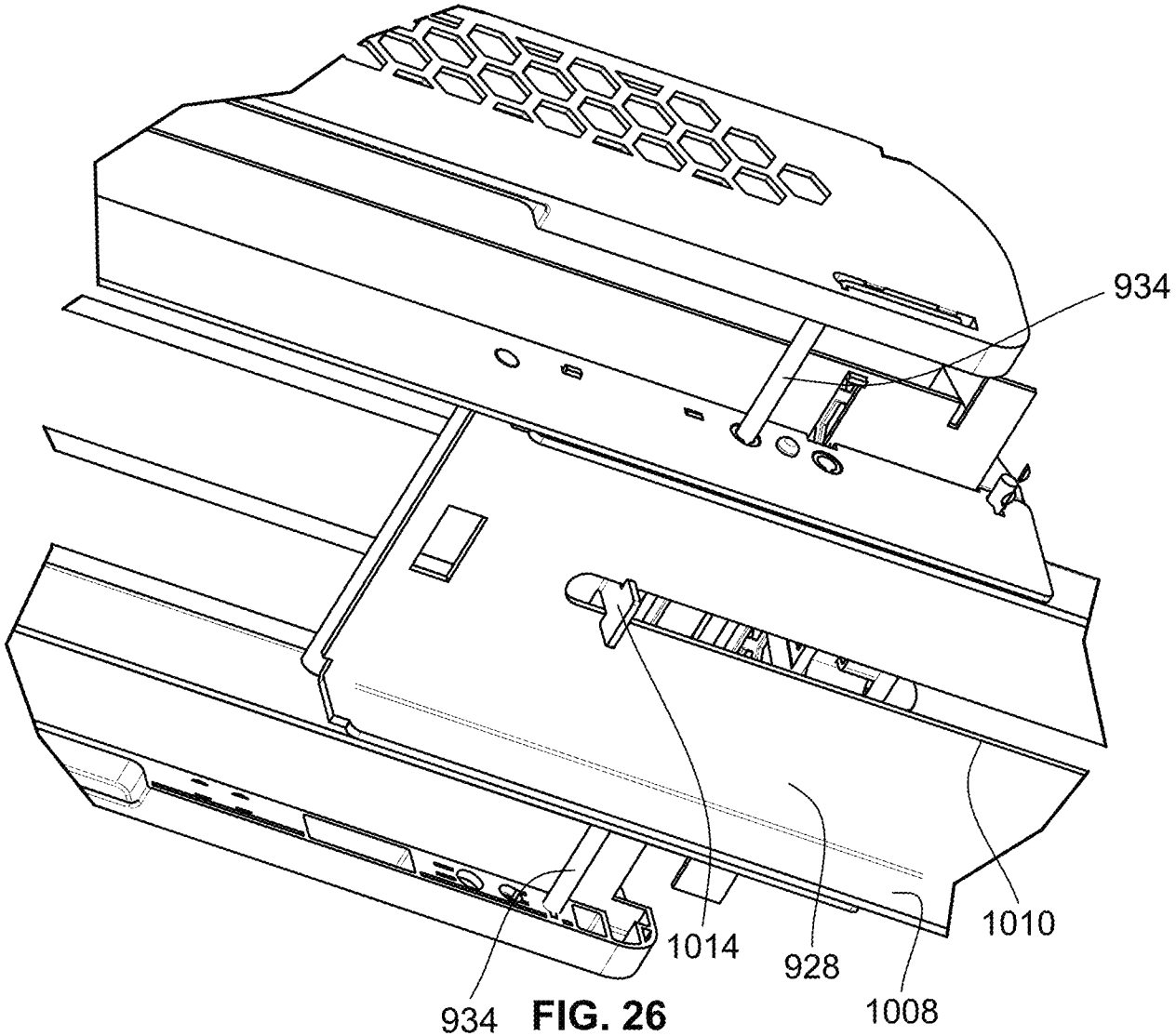
FIG. 26 is a partial perspective view of the retail merchandise tray of FIG. 24.

FIG. 26 illustrates the aforementioned tab and slot configuration. As may be seen in this view, tab 1014 is generally T-shaped such that it cannot easily be displaced from slot 1010 once situated therein.

Figure 27:
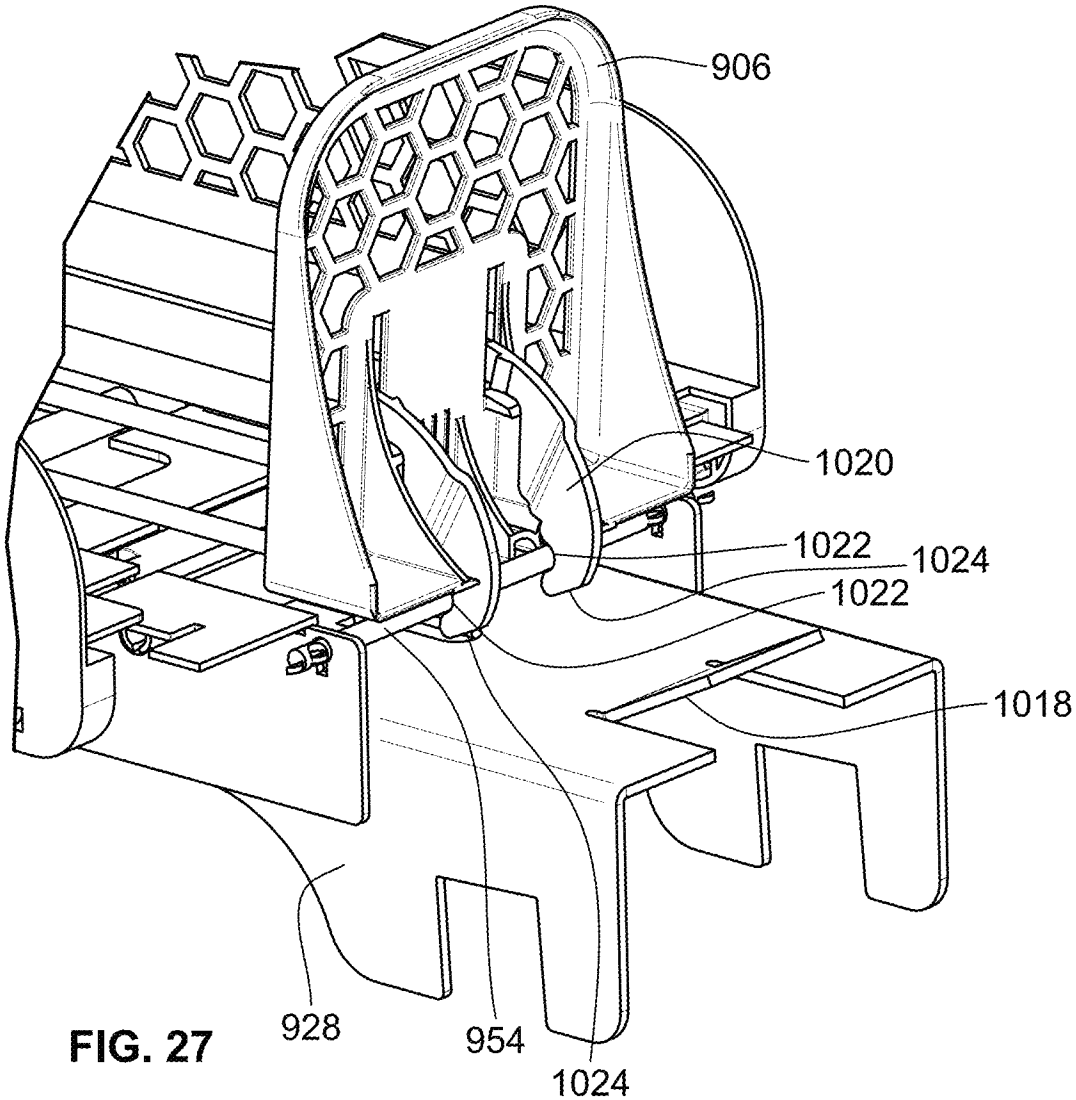
FIG. 27 is a partial perspective view of the retail merchandise tray of FIG. 24 illustrating a locking arm of the retail merchandise tray.

As indicated above, tray 900 also incorporates a pusher locking system with an auto unlocking feature. With reference to FIG. 27, this locking system includes a locking arm 1020. Locking arm 1020 includes notches 1022 which are designed to receive a crossbar 954 of wire support structure 910. At any time, pusher 906 may be locked relative to crossbar 954 by simply rotating locking arm 1020 so as to engage notches 1022 with crossbar 954. The biasing force provided by a biasing element connected between pusher 906 and the front end of tray 900 pulls these notches 1022 into engagement with crossbar 954. As a result, pusher 906 is prevented from moving towards front stop 904.

This locking feature advantageously allows the user to lock the pusher in its rearmost position, and then rapidly load a row of retail merchandise into tray 900. Such a feature facilitates the rapid reloading of tray 900. This feature, when taken in combination with the sliding capability of baffle plate 928 to pull tray 900 forward for ease of access for top loading operations provides for a highly efficient means of restocking tray 900 as needed. However, as noted above, when tray 900 is contained in a racking system, it is difficult to access portions of the tray especially the rear area of the tray when tray 900 is returned to its first position or the position shown in FIG. 24. As such, it is difficult to access the above-described locking arm in such a position. To alleviate this issue, baffle plate 928 also includes an unlocking tab 1018 as may be readily seen in FIG. 25. As baffle plate 928 slides in direction 1006 relative to the remainder of tray 900, this unlocking tab 1018 will be brought into contact with locking arm 1020. Such a configuration may be seen in FIG. 28.

Figure 28:
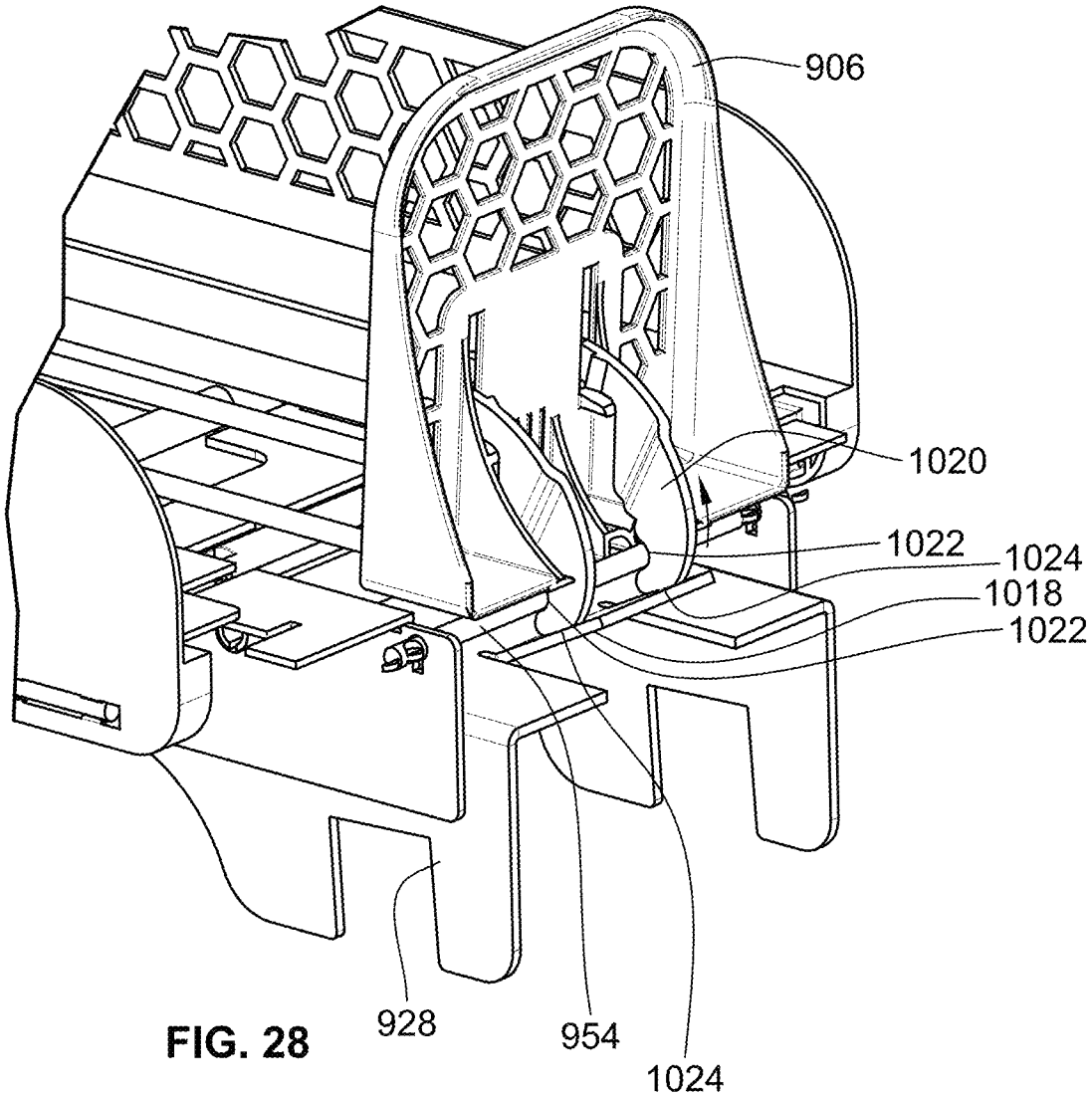
FIG. 28 is another partial perspective view of the locking arm of FIG. 27.

Indeed, in FIG. 28, unlocking tab 1018 is nearing contact with angled surfaces 1024 formed on the arms of locking arm 1020. Once unlocking tab 1018 contacts these angled services 1024 upon continued movement of baffle plate 928 in direction 1006, locking arm 1020 will be unhooked or forced out of contact with crossbar 954. This configuration thus provides an automatic unlocking function upon movement of baffle plate 928 relative to the remainder of tray 900.

Turning now to FIGS. 29-38, an alternate embodiment of tray 1100 is illustrated. This embodiment is identical to the embodiment of the prior trays discussed above, except for the following notable differences. Accordingly, and for purposes of brevity, a redundant description of the same structure discussed above is dispensed with. Further, any optional features of the prior trays not expressly shown in FIGS. 29-38 may be incorporated into the embodiment of FIGS. 29-38 unless directly contrary.

Indeed, tray 1100 incorporates a frame that includes load bearing members 1102, wire support frame 1110 and spacers 1112. The frame provides a retail merchandise support surface upon which merchandise is supported. Frames that combine two or more of these structures are contemplated (e.g. all three components could be a single component in other embodiments). Tray 1100 incorporates a front stop 1104 and pusher 1106 which are identical in form and function as those same components discussed above relative to other embodiments. The divider assemblies 1108 are similar to divider assembly 208 but have a different construction. These divider assemblies 1108 are identical so a description of one applies equally well to the other. Additionally, this embodiment also incorporates a baffle plate 1128 along the underside of tray 1100 that is the same as baffle plate 228 described above.

As is also generally understood in the art, baffle plates are employed to prevent denser cold air in a refrigerated environment from rapidly passing past the upper most trays in a refrigerated case or the like. Such baffle plates typically slow this flow of cold air such that the upper trays and the lower trays are generally exposed to the same amount of cold air. Maintaining this principle in the instant embodiment, divider assemblies 1108 also employ their own baffle plate extension such that when divider assemblies 1108 are extended (e.g. to accommodate wider product), a continuous baffle plate surface is presented across the width of tray 1100. This configuration provides the same advantage of slowing or preventing the undesirable flow of cold air past tray 1100, but has the advantage of a self-contained baffle arrangement as mentioned above.

Figure 29:
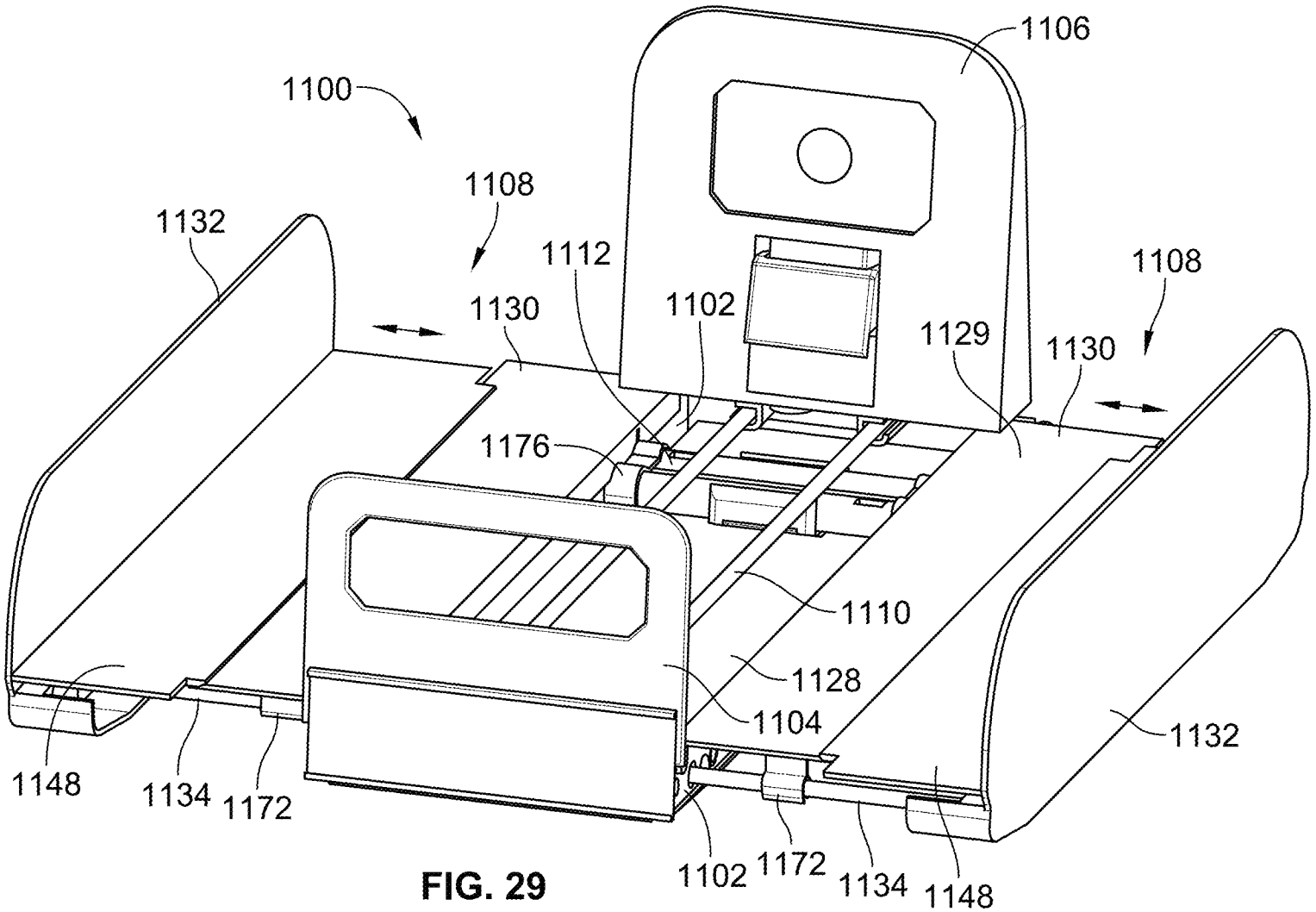
FIG. 29 is a perspective view of a further retail merchandise tray according to the teachings herein in an extended orientation.
Figure 30:
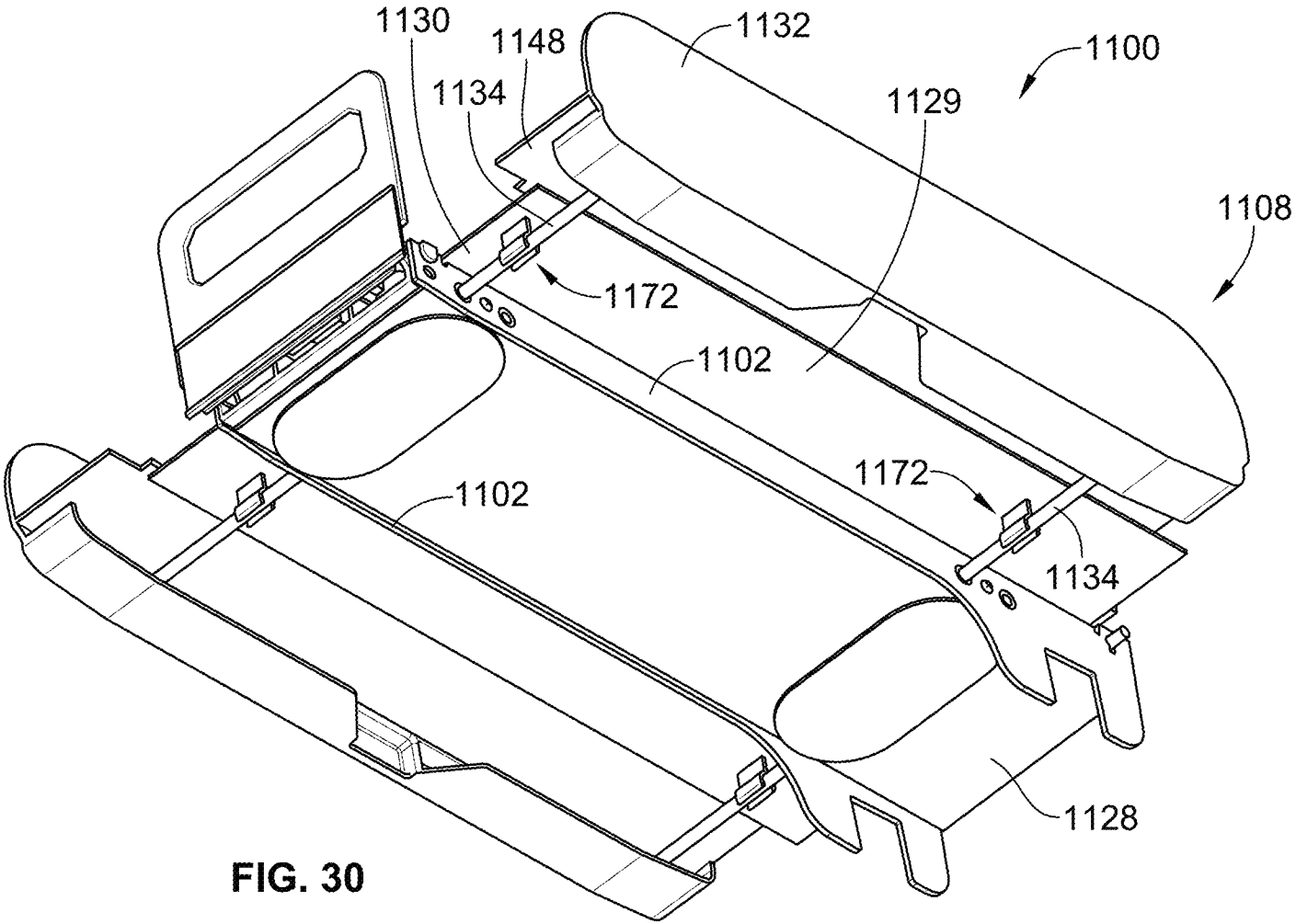
FIGS. 30 and 31 are bottom perspective views of the retail merchandise tray of FIG. 29 (with and without a bottom baffle plate)
Figure 31:
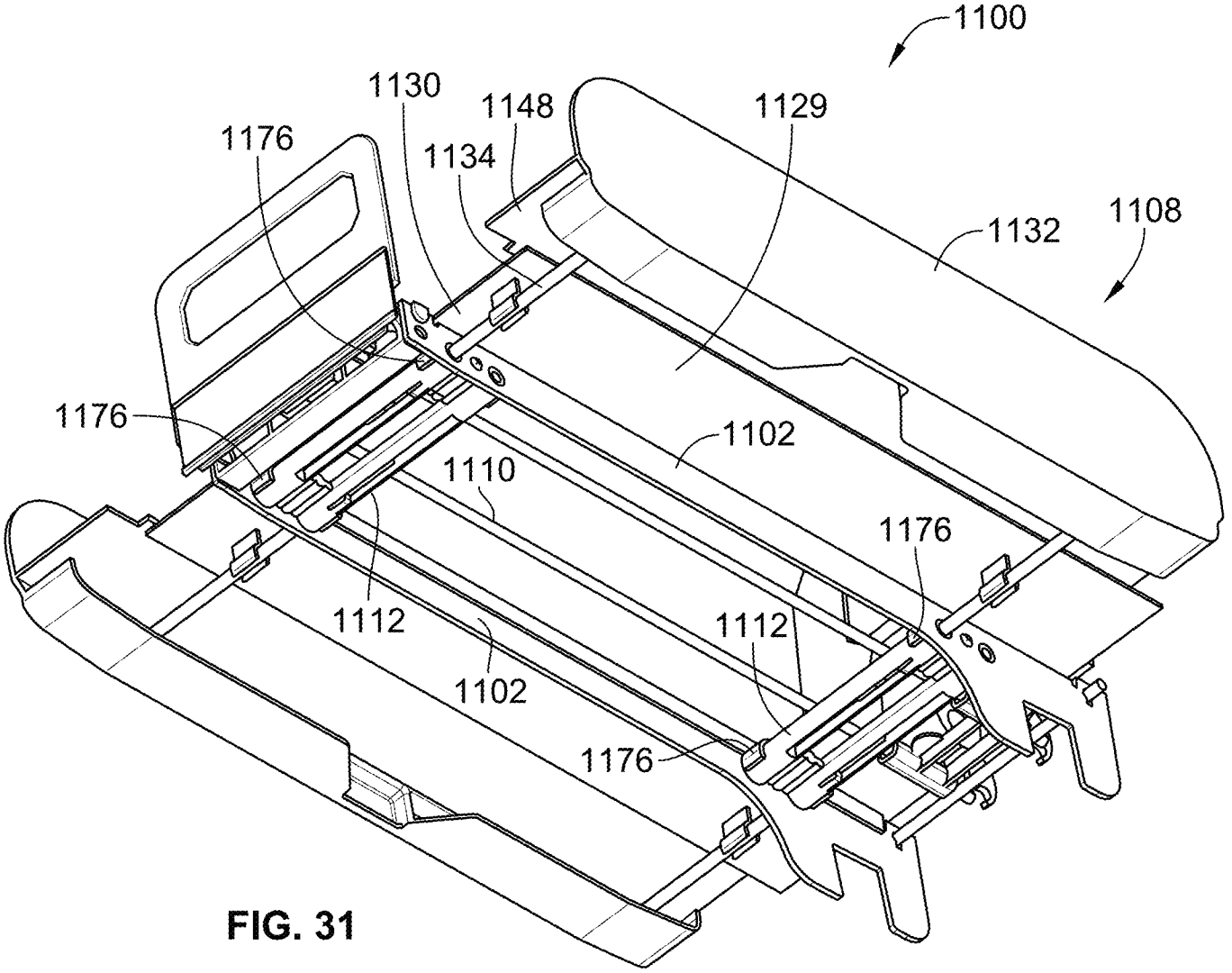
Figure 32:
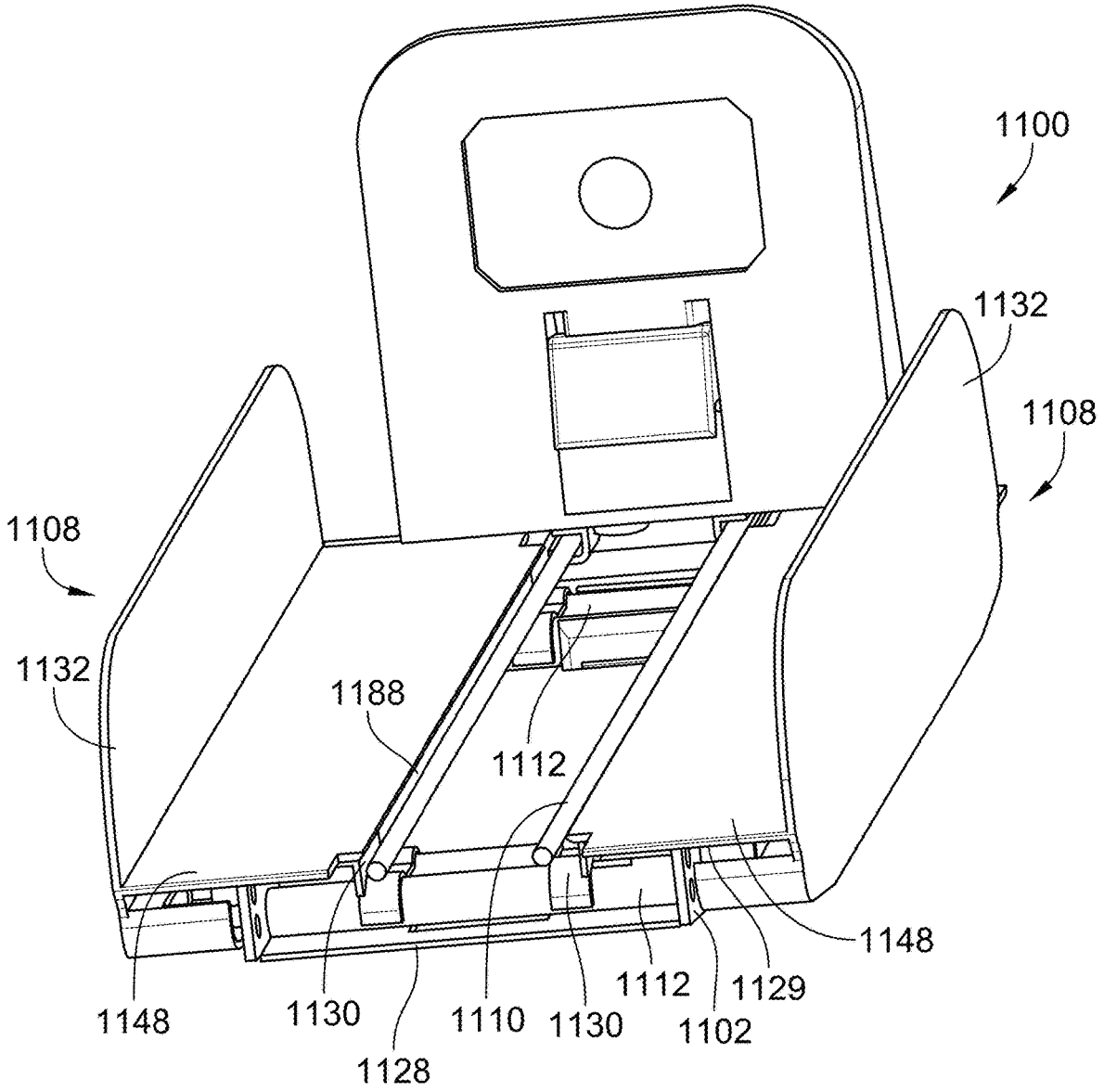
FIG. 32 is a top perspective view of the retail merchandise tray of FIG. 29 in a compressed orientation.
Figure 33:
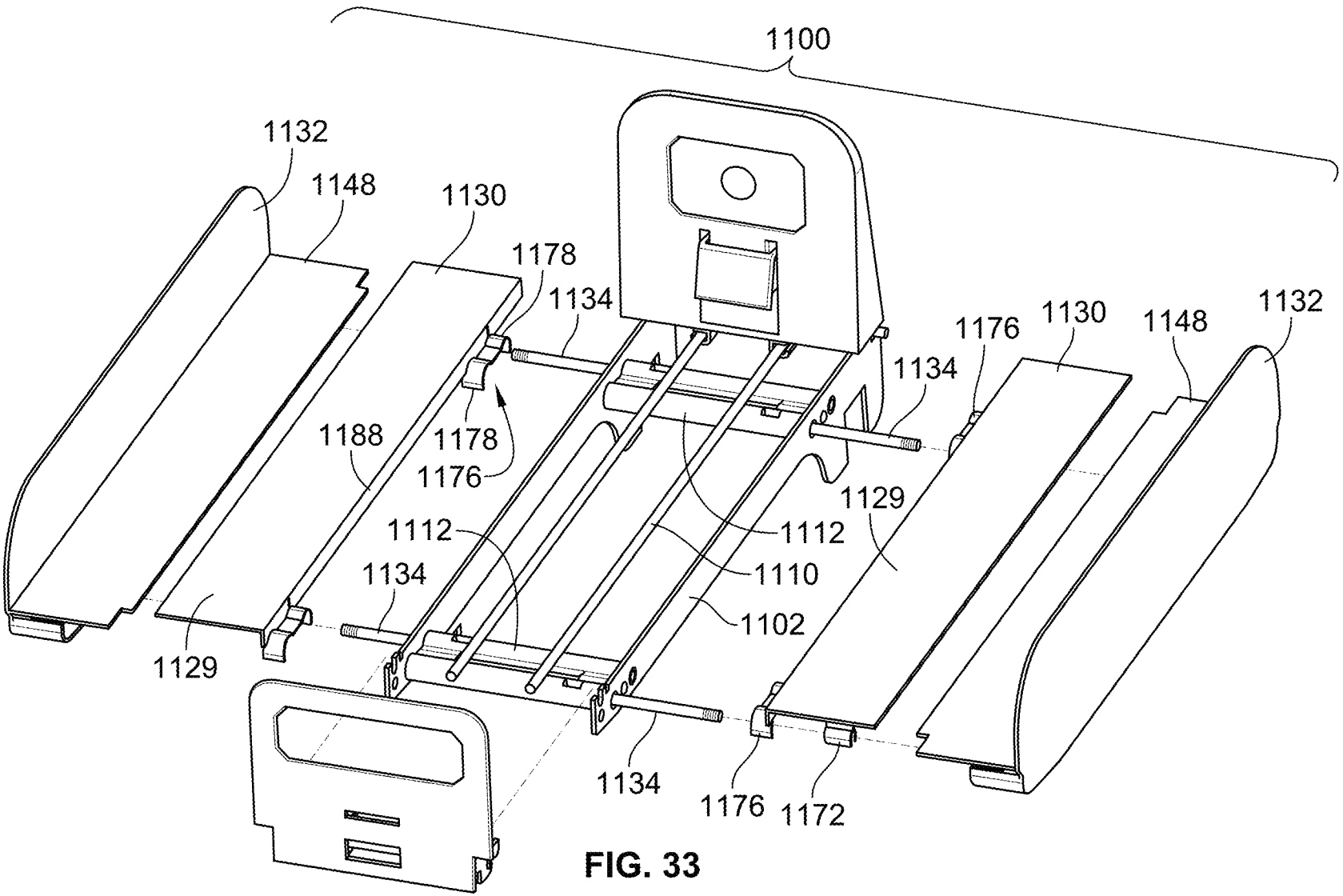
FIG. 33 is a top perspective exploded view of the retail merchandise tray of FIG. 29.
Figure 34:
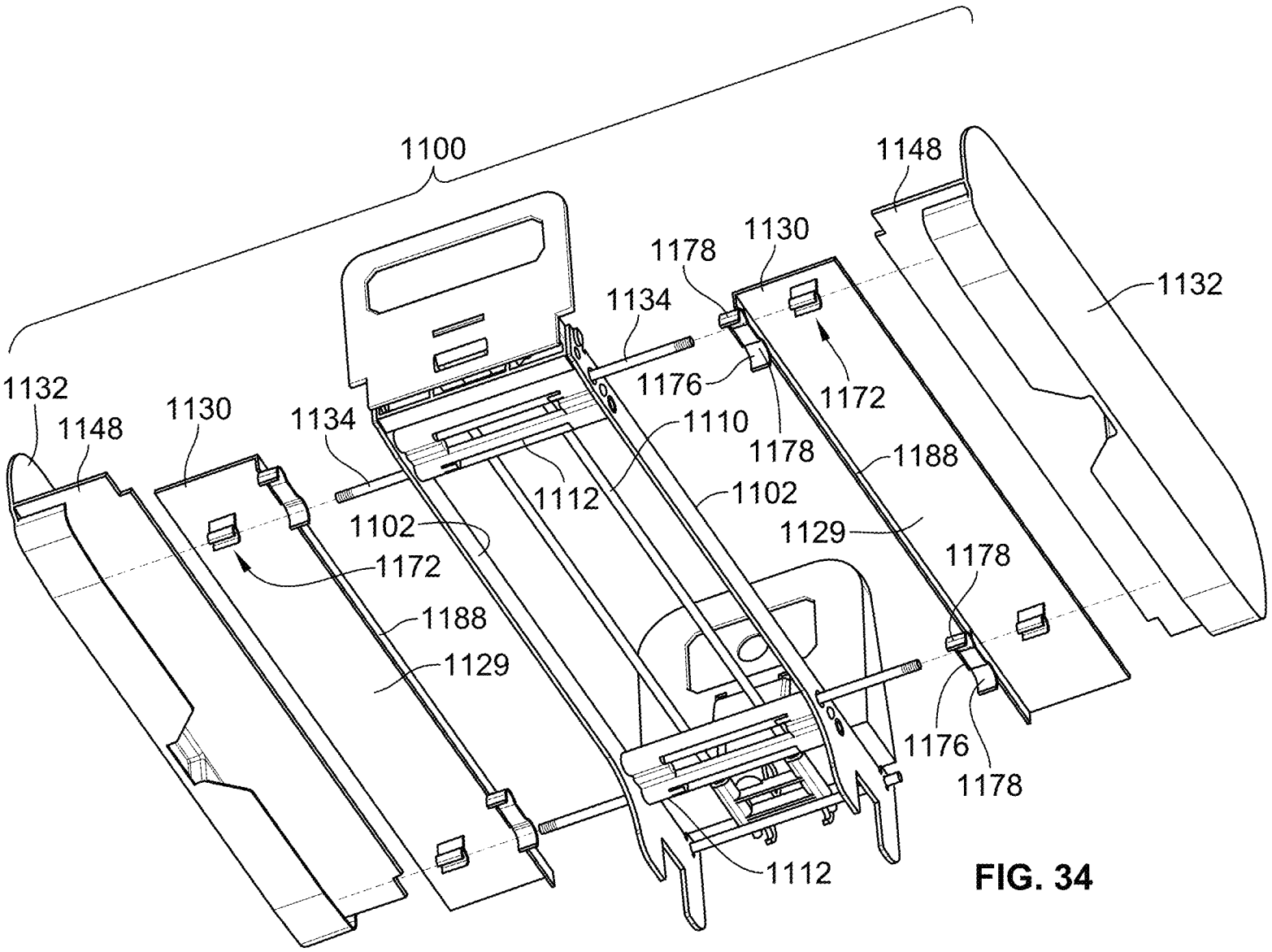
FIG. 34 is a bottom perspective exploded view of the retail merchandise tray of FIG. 29

To this end, and turning now to FIGS. 29 and 30, each divider assembly 1108 includes a divider wall 1132 attached to wire supports 1134 in the same manner as discussed above. However, divider assembly 1108 also includes a baffle plate extension 1130. A slidable connection is formed between baffle plate extension 1130 and wire supports 1134, unlike the prior embodiment where the slideable connection is provided between the baffle plate extension 230 and flange 248 of divider wall 232.

The slidable connection between baffle plate extension 1130 and wire supports 1134 includes clips 1172 extending from an underside of the main panel 1129 of baffle plate extension 1130 that snap engage wire supports 1134. The clips 1172 engage wire supports 1134 with a degree of friction that allows the baffle plate extension 1130 to slide laterally outward relative to the frame with the wire supports 1134 as the wire supports are slid laterally outward as the divider wall 1132 is spaced outward and away from the frame (e.g. outward from structures 1102/1110).

While the illustrated clips 1172 have a C-shaped end that has a mouth that allows for attachment to wire supports 1134 while the wire supports are connected to the frame and the divider wall 1123, other embodiments of the clips could have an end that is a completed ring that requires insertion of the wire supports 1134 through the ring.

In addition to clips 1172, the baffle plate extensions include an inner sliding support member that slidably supports the baffle plate extensions 1130 relative to the frame. In this embodiment, the inner sliding support member is in the form of inner slidable clips 1176 that are the same as clips 276 described previously. Slidable clips 1176 are better seen in FIGS. 33-38. These inner slidable clips 1176 include receiving portions 1178 which clip partially around corresponding portions of spacers 1112. As such, the baffle plate extensions 1130 are affixed to but slidable along spacers 1112.

The engagement between clips 1172 and wire supports 1134 is greater than the engagement between inner slidable clips 1176 and spacers 1112 (e.g. the frame). As such, when the tray 1100 is transitioned between a compressed orientation (see e.g. FIGS. 32 and 35) and an extended orientation (see e.g. FIGS. 29 and 37), the slidable clips 1176 slide relative to spacer 1112 before clips 1172 slide relative wire supports 1134.

Figure 35:
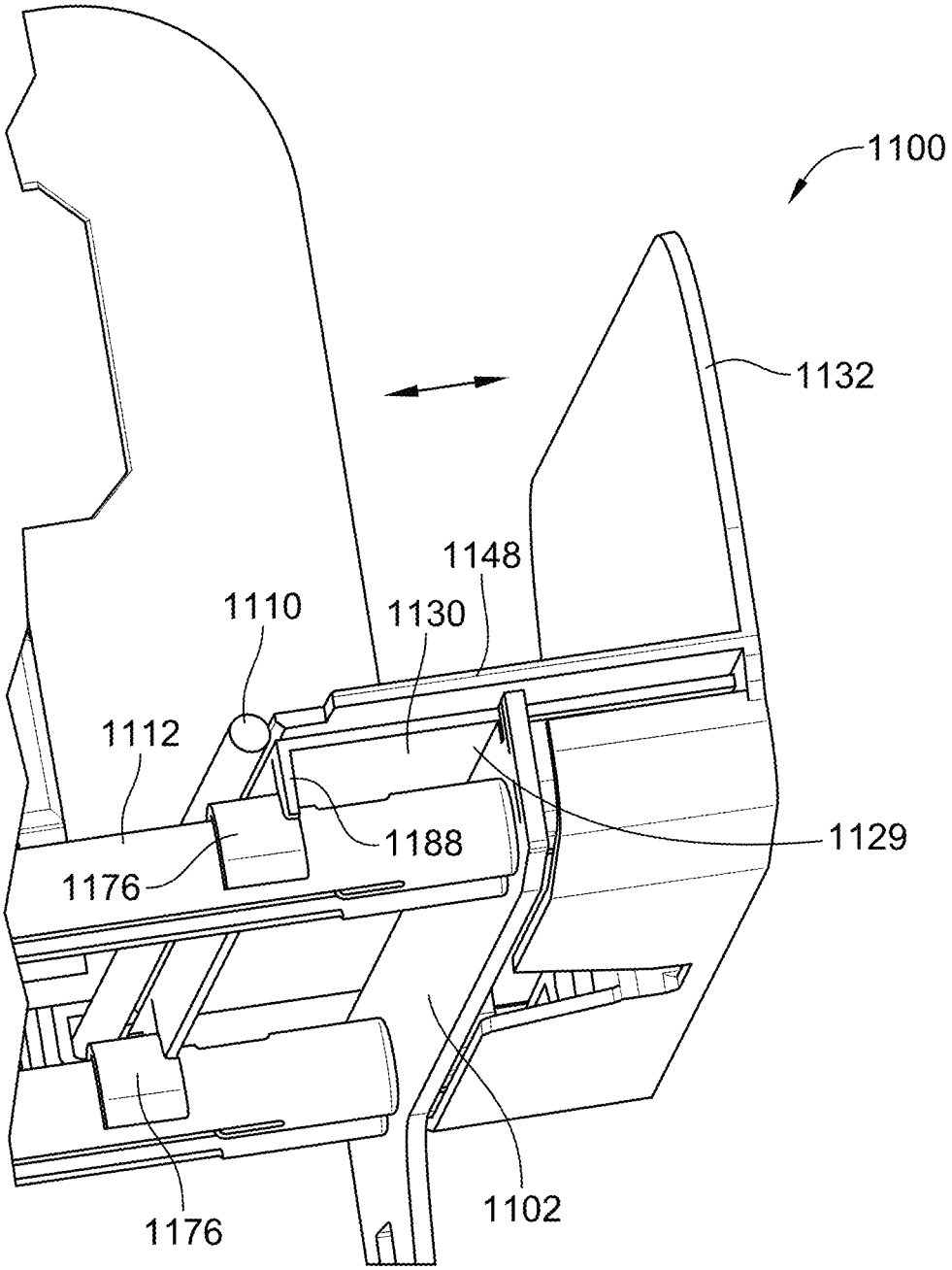
FIG. 35 is a partial illustration of the retail merchandise tray of FIG. 29 in a compressed orientation.
Figure 36:
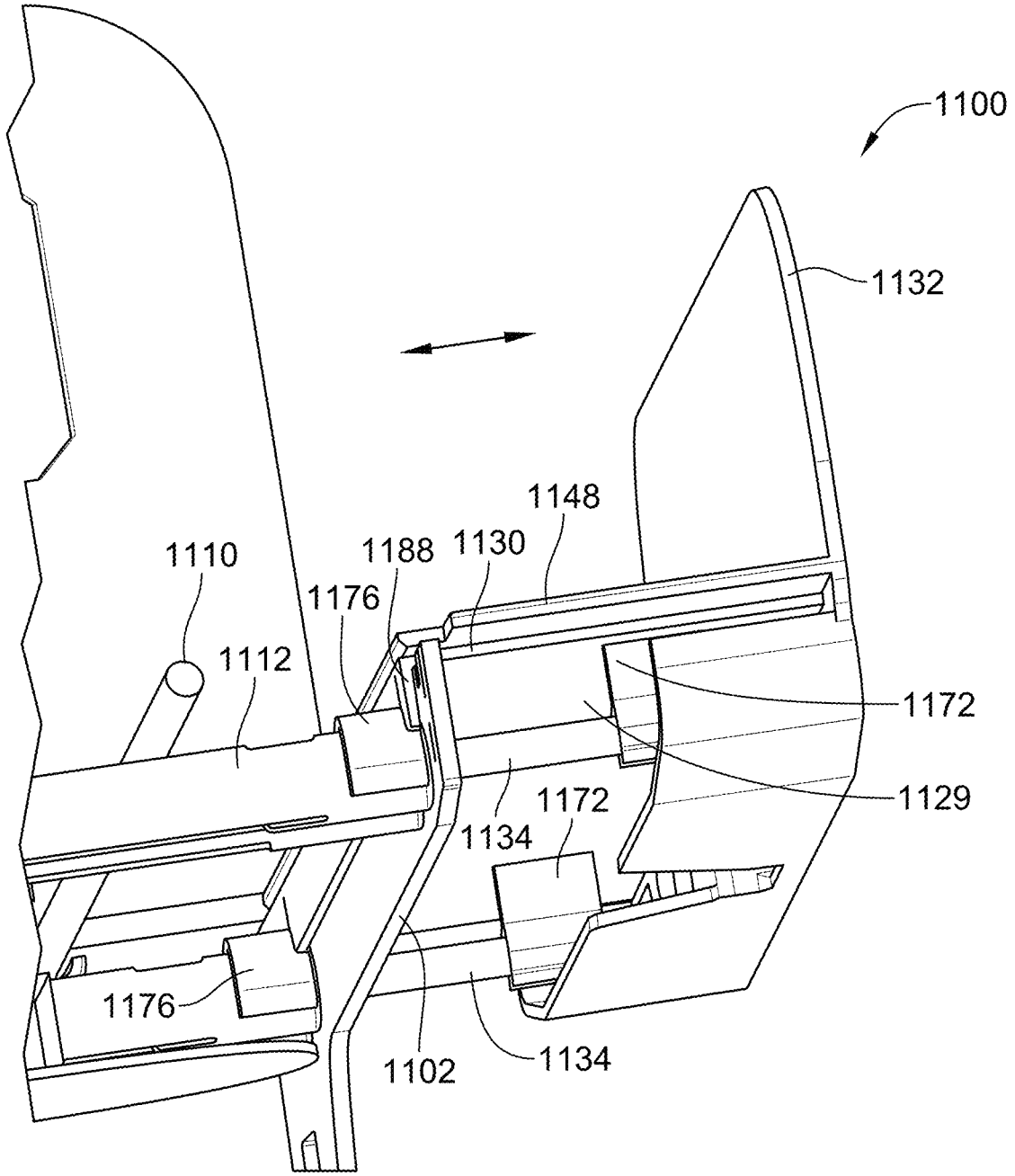
FIG. 36 is a partial illustration of the retail merchandise tray of FIG. 29 in a partially expanded orientation.
Figure 37:
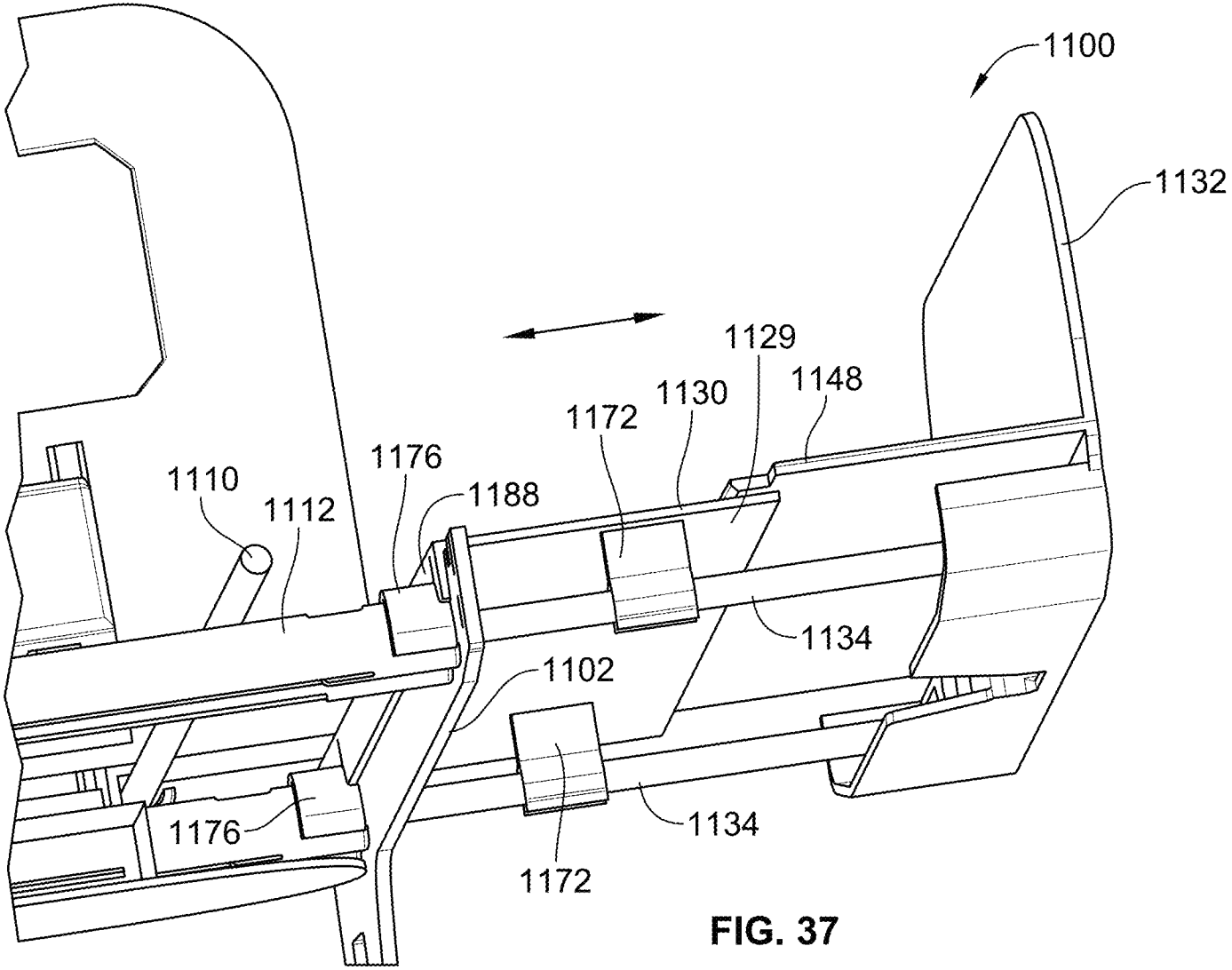
FIG. 37 is a partial illustration of the retail merchandise tray of FIG. 29 in a fully expanded orientation.
Figure 38:
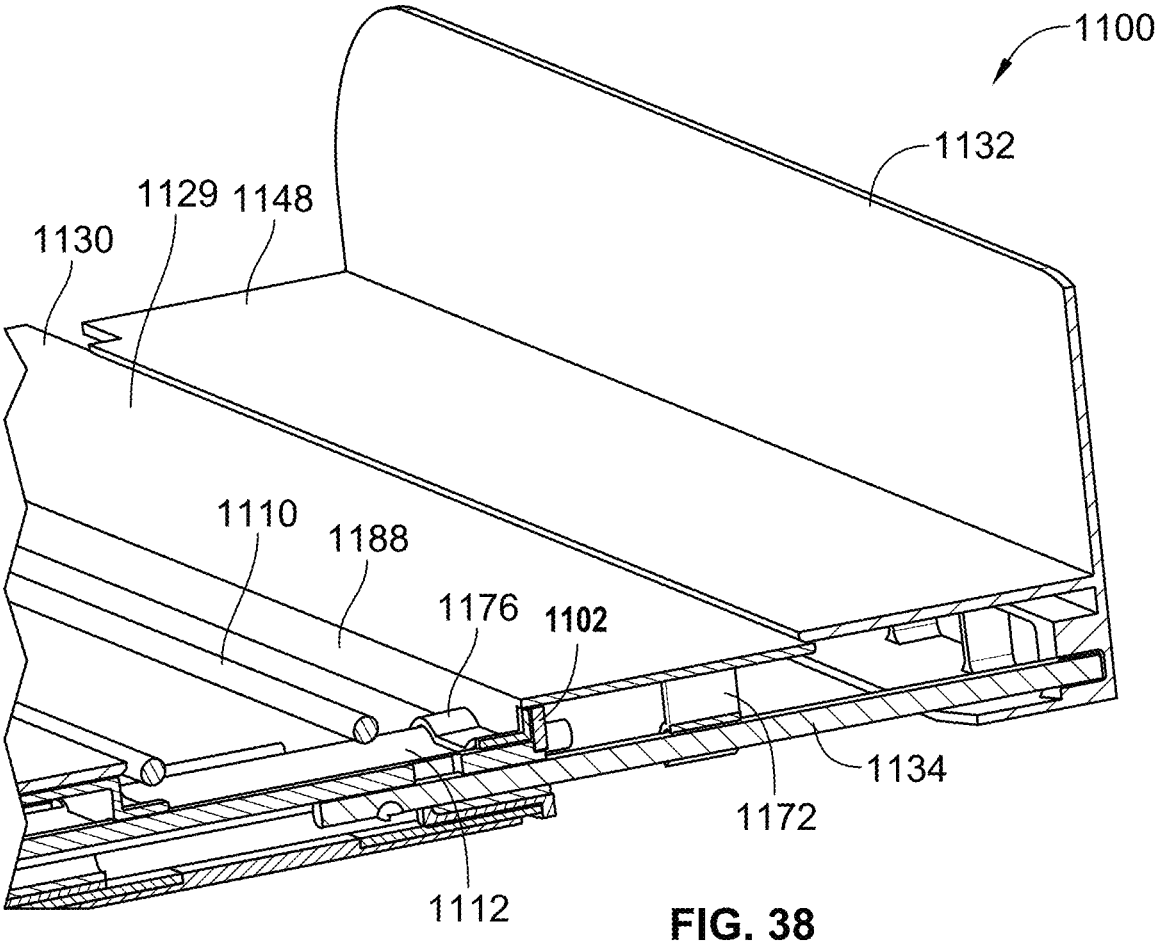
FIG. 38 is a partial cross-sectional illustration of the retail merchandise tray of FIG. 29 in the fully expanded orientation.

With reference to FIGS. 35-37, as the diver assembly 1108 begins to transition from the compressed orientation (FIG. 35) toward the extended orientation (FIG. 37), the baffle plate extension 1130 moves laterally outward with the divider wall 1132 due to the relatively higher frictional engagement between clips 1172 and wire supports 1134 as compared to clips 1176 and spacers 1112.

Once the downwardly depending extension portion 1188 of the baffle plate extension 1130 forms a stop that abuts the frame and particularly an inner side of load bearing member 1102 (see e.g. FIG. 36), clips 1172 slide relative to wire supports 1134 as the divider wall 1132 is further extended until it reaches the fully extended orientation (FIG. 37). During this transition, the baffle plate extension 1130 will slide out from underneath flange 1148 that is integrally formed with the upstanding divider wall 1132.

As in the embodiment above that included baffle plate extension 230, by providing baffle plate extension 1130, a continuous baffle plate surface is provided in the compressed orientation, the fully extended orientation or any orientation therebetween.

When transitioning from the fully extended orientation toward the compressed orientation, due to the increased friction between clips 1172 and wire supports 1134 as compared to clips 1176 and the frame (e.g. spacers 1112), clips 1176 will first slide on spacers 1112 until clips 1172 laterally abut the outer side of load bearing member 1102 when the divider wall 1132 is moved towards load bearing member 1102.

Thereafter, with continued inward motion of divider wall 132, the baffle plate extension 1130 remain in fixed position and the clips 1172 will slide relative to wire supports 1134 until the divider wall 1132 is in its fully compressed orientation.

Clips 1176 could simply ride along the frame and particularly spacers 1110 and not vertically secure the baffle plate extensions 1130 to the frame and particularly spacers 1110. In other words, the receiving portions 1178 of clips 1176 may not have any undercuts such that lifting baffle plate extensions 1130 off of spacers 1110 provides not load on spacers 1110.

Figure 39:
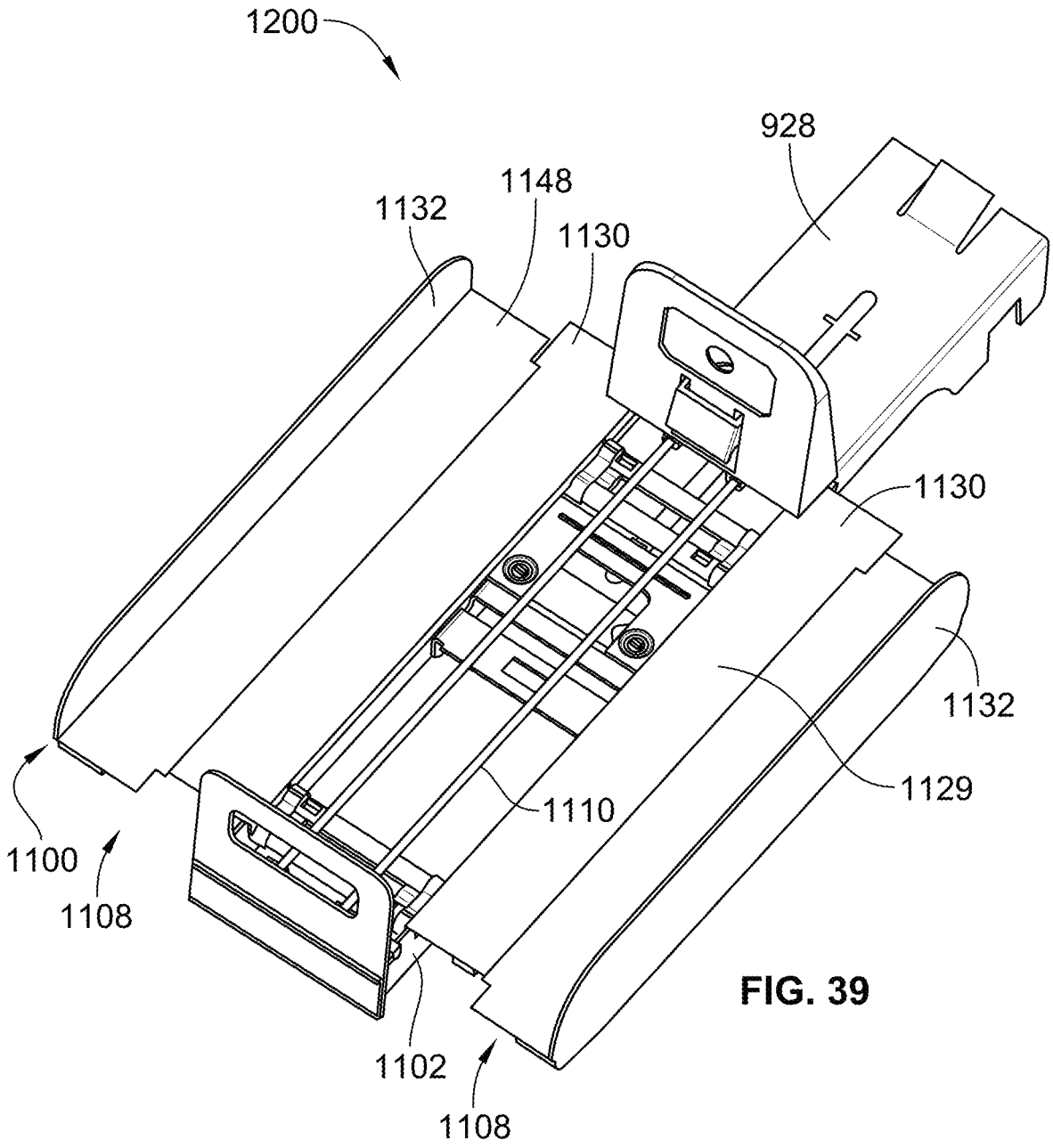
FIG. 39 is a further embodiment of a retail merchandise tray including the baffle plate of FIG. 25 in combination with the tray of FIG. 29.

FIG. 39 illustrates a further tray 1200 that incorporates the tray 1100 but mounted to baffle plate 928 of the prior embodiment. This embodiment does not include baffle plate 1128 (e.g. baffle plate 228). The movement of the tray assembly 1100 relative to baffle plate 928 is the same as explained previously for system 900 above but with the different divider assemblies 1108.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise tray, comprising:

a frame providing a retail merchandise support surface extending along a first axis between a front end and a rear end;

at least one divider assembly movable relative to the frame along a second axis perpendicular to the first axis, the at least one divider assembly including:

a divider wall;

at least one wire support, the at least one wire support slidably attaching the divider wall to the frame for movement along the second axis between a retracted orientation and an extended orientation; and a baffle plate extension connected to the at least one wire support by a slidable connection, the baffle plate extension being moveable relative to the divider wall along the second axis, the baffle plate extension including a downward extending stop that laterally engages the frame and limits the outward travel of the baffle plate extension relative to the frame as the divider wall is transitioned from the retracted orientation to the extended orientation, the divider wall travels a first distance along the second axis between the retracted orientation and the extended orientation, the baffle plate extension travels a second distance, less than the first distance, along the second axis when the divider wall transitions between the retracted orientation and the extended orientation.

2. The retail merchandise tray of claim 1, wherein the slidable connection between the at least one wire support and the baffle plate extension is provided by an outer clip portion of the baffle plate extension that engages the at least one wire support.

3. The retail merchandise tray of claim 1, wherein when transitioning the divider wall to the extended orientation from the retracted orientation, the stop engages the frame limiting outward motion of the baffle plate extension before the divider wall reaches the extended orientation.

4. The retail merchandise tray of claim 3, wherein the first amount of sliding friction and second amount of sliding friction are such that the baffle plate extension does not slide relative to the at least one wire support when transitioning the divider wall from the retracted orientation to the extended orientation until the stop engages the frame.

5. The retail merchandise tray of claim 1, wherein:

the divider wall includes an upright portion having opposed sides and a flange extending from at least one of the opposed sides perpendicular to the upright portion; and in the retracted orientation, the flange overlaps both a portion of the frame and the baffle plate extension with the baffle plate extension being positioned between the flange and the portion of the frame.

6. The retail merchandise tray of claim 1, wherein:

the baffle plate extension includes a main panel portion and an outer clip portion, the outer clip portion extending downward from a bottom side of the main panel portion that faces the at least one wire support;

the outer clip portion is positioned laterally outward beyond a first side of the frame along the second axis;

the outer clip portion slidably engages the at least one wire support and provides the first amount of sliding friction.

7. The retail merchandise tray of claim 6, wherein the main panel portion and outer clip portion are unitarily formed as a one-piece construction.

8. The retail merchandise tray of claim 6, wherein:

the stop is positioned laterally inward of the first side of the frame along the second axis;

the baffle plate extension includes an inner sliding support member that slidably rests on a portion of the frame providing the second amount of sliding friction, the inner sliding support member being positioned laterally inward of the first side of the frame along the second axis such that the first side of the frame is positioned laterally between the outer clip portion and the inner sliding support member.

9. The retail merchandise tray of claim 8, wherein the inner sliding support member is an inner clip that engages the portion of the frame along which the inner sliding support member slides.

10. The retail merchandise tray of claim 6, wherein the main panel portion of the baffle plate extension is free of slots or grooves therein.

11. The retail merchandise tray of claim 10, wherein the divider wall includes an upright portion having opposed sides and a flange extending from at least one of the opposed sides perpendicular to the upright portion, the flange being free of slots or grooves therein.

12. The retail merchandise tray of claim 10, wherein the divider wall includes an upright portion having opposed sides and a flange extends from at least one of the opposed sides perpendicular to the upright portion, in the retracted orientation, the flange overlaps both a portion of the frame and the baffle plate extension with the baffle plate extension being positioned between the flange and the portion of the frame.

13. The retail merchandise tray of claim 6, wherein the outer clip portion laterally abuts the frame when the divider wall is in the retracted orientation.

14. The retail merchandise tray of claim 1, wherein the frame includes:

a pair of opposed load bearing members;

a wire support structure having opposed first and second ends, the first axis extending between the first and second ends, the wire support structure being supported by the pair of opposed load bearing members;

at least one spacer interposed between the pair of load bearing members and extending along the second axis; and wherein the baffle plate extension includes an inner sliding support member that slidably rests on the at least one spacer providing the second amount of sliding friction, the inner sliding support member being positioned laterally between the pair of opposed load bearing members.

15. The retail merchandise tray of claim 14, wherein:

the baffle plate extension includes a main panel portion and an outer clip portion;

the outer clip portion extending downward from a bottom side of the main panel portion that faces the at least one wire support;

the outer clip portion is positioned laterally outward beyond the load bearing members such that both load bearing members are on a same side of the clip;

the outer clip portion slidably engages the at least one wire support and provides the first amount of sliding friction.

16. The retail merchandise tray of claim 15, wherein:

the outer clip portion laterally abuts a first side of one of the load bearing members in the retracted orientation and the inner sliding support member is spaced from the one of the load bearing members in the retracted orientation;

the outer clip portion is laterally spaced from the first side of the one of the load bearing members in the extended orientation and the inner sliding support member abuts a second side of the one of the load bearing members in the extended orientation.

17. A method of transitioning a retail merchandise tray between a retracted orientation and a extended orientation comprising:

applying force to a divider wall of a divider assembly of the retail merchandise tray to slide the divider wall relative to a frame for a first distance, the frame providing a retail merchandise support surface extending along a first axis between a front end and a rear end the divider assembly being movable relative to the frame along a second axis perpendicular to the first axis, the at least one divider assembly further including:

at least one wire support, the at least one wire support slidably attaching the divider wall to the frame for movement along the second axis between the retracted orientation and the extended orientation; and a baffle plate extension connected to the at least one wire support by a slidable connection, the baffle plate extension being moveable relative to the divider wall along the second axis, the baffle plate extension including a downward extending stop that laterally engages the frame and limits the outward travel of the baffle plate extension relative to the frame as the divider wall is transitioned from the retracted orientation to the extended orientation, the divider wall travels the first distance along the second axis between the retracted orientation and the extended orientation, the baffle plate extension travels a second distance, less than the first distance, along the second axis when the divider wall transitions between the retracted orientation and the extended orientation;

moving the baffle plate extension along the second axis with the divider wall for the second distance due to the first amount of sliding friction provided between the slidable connection between the baffle plate extension and the at least one wire support while overcoming the second amount of sliding friction between the baffle plate extension and the frame;

stopping motion of the baffle plate extension along the second axis; and continuing to move the divider wall relative to the frame while the baffle plate extension is stopped by overcoming the first amount of sliding friction between the baffle plate extension and the at least one wire support.

18. The method of claim 17, wherein the step of stopping motion of the baffle plate extension occurs by abutting a stop of the baffle plate extension against a portion of the frame.

19. A retail merchandise tray, comprising:

a frame providing a retail merchandise support surface extending along a first axis between a front end and a rear end;

at least one divider assembly movable relative to the frame along a second axis perpendicular to the first axis, the at least one divider assembly including:

a divider wall;

at least one wire support, the at least one wire support slidably attaching the divider wall to the frame for movement along the second axis between a retracted orientation and an extended orientation; and a baffle plate extension connected to the at least one wire support by a slidable connection, the baffle plate extension being slidably supported by the frame providing a second amount of sliding friction less than the first amount of sliding friction such that the baffle plate extension is slidable relative to the frame and the at least one wire support, the baffle plate extension being moveable relative to the divider wall along the second axis.

* * * * *